US011554909B2

(12) United States Patent
Chen

(10) Patent No.: US 11,554,909 B2
(45) Date of Patent: Jan. 17, 2023

(54) BAG DISPENSING APPARATUS AND BAG DISPENSING SYSTEM

(71) Applicant: Benzhi (Shenzhen) Information Technology Co., Ltd., Guangdong (CN)

(72) Inventor: Xihong Chen, Shenzhen (CN)

(73) Assignee: BENZHI (SHENZHEN) INFORMATION TECHNOLOGY CO., LTD., Guangdong (CN)

( * ) Notice: Subject to any disclaimer, the term of this patent is extended or adjusted under 35 U.S.C. 154(b) by 129 days.

(21) Appl. No.: 17/121,755

(22) Filed: Dec. 15, 2020

(65) Prior Publication Data

US 2021/0179340 A1 Jun. 17, 2021

(30) Foreign Application Priority Data

Dec. 16, 2019 (CN) ..... 201922254727.3

(51) Int. Cl.
*B65D 83/08* (2006.01)
*B65D 33/00* (2006.01)
*B65F 1/00* (2006.01)

(52) U.S. Cl.
CPC ..... *B65D 83/0894* (2013.01); *B65D 33/002* (2013.01); *B65F 1/0006* (2013.01)

(58) Field of Classification Search
CPC .... B65F 1/0006; B65F 1/062; B65D 83/0894; B65D 33/002; A47F 2009/044
USPC ..... 221/63, 26
See application file for complete search history.

(56) References Cited

U.S. PATENT DOCUMENTS 2,930,664 A * 3/1960 Liebisch ..... A47K 10/3656 242/564.2
3,107,957 A * 10/1963 Batlas ..... A47K 10/3687 226/188
3,924,476 A * 12/1975 Wolcott ..... A47K 10/36 74/30
5,577,634 A * 11/1996 Morand ..... A47K 10/3818 221/33
5,630,526 A * 5/1997 Moody ..... A47K 10/16 221/45
5,738,239 A * 4/1998 Triglia ..... B65F 1/062 220/495.07
5,810,234 A * 9/1998 Burli ..... A47F 9/042 225/106
5,975,394 A * 11/1999 Shuval ..... B65H 35/10 225/106
2005/0056718 A1* 3/2005 Kamenstein ..... A47K 10/3836 242/422.4

(Continued)

FOREIGN PATENT DOCUMENTS

CN 211765280 U * 10/2020 ..... A47G 29/087
GB 2510277 A * 7/2014 ..... B65B 41/16

(Continued)

*Primary Examiner* — Rakesh Kumar
(74) *Attorney, Agent, or Firm* — Leong C. Lei

(57) ABSTRACT

A bag dispensing apparatus and a bag dispensing system are disclosed. The bag dispensing apparatus includes a housing, a bag retaining mechanism, and a bag locking mechanism. A roll of bags is stored in the bag dispensing apparatus and a leading bag of the roll of bags can be directly hanged on the bag dispensing apparatus for use. The storage and use of the bags are cleverly integrated to save the space, and the operation is more convenient.

9 Claims, 18 Drawing Sheets

(56) References Cited

U.S. PATENT DOCUMENTS

| | | | | |
|---|---|---|---|---|
| 2006/0118588 | A1* | 6/2006 | Edwards | B65H 35/10 225/53 |
| 2012/0137978 | A1* | 6/2012 | McBounds | A01K 27/004 119/796 |

FOREIGN PATENT DOCUMENTS

| | | | | | |
|---|---|---|---|---|---|
| GB | 2544828 | A | * | 5/2017 | A47K 10/3827 |
| GB | 2558706 | A | * | 7/2018 | A47K 10/3845 |
| GB | 2558707 | A | * | 7/2018 | B65H 16/005 |
| JP | 2000025393 | A | * | 1/2000 | B65H 37/007 |
| KR | 102213504 | B1 | * | 2/2021 | B65F 1/062 |
| KR | 102213504 | B1 | * | 5/2021 | B65F 1/06 |
| WO | WO-2012034235 | A1 | * | 3/2012 | B65D 33/002 |
| WO | WO-2012056446 | A1 | * | 5/2012 | A47F 9/043 |
| WO | WO-2022064535 | A1 | * | 3/2022 | B65D 77/067 |

* cited by examiner

BAG DISPENSING APPARATUS AND BAG DISPENSING SYSTEM

BACKGROUND OF THE INVENTION

1. Field of the Invention

The present invention relates to an apparatus for dispensing bags, and more particularly to a bag dispensing apparatus and a bag dispensing system, which is mainly but not limited to vehicle-mounted use.

2. Description of the Prior Art

Bags on a roll are widely used nowadays, such as food plastic bags, trash bags, etc. In general, plastic bags are continuously wound on a winding roll. The winding roll is generally a hollow cylindrical structure. When in use, the winding roll is sleeved on a shaft. The user pulls a leading bag of the roll of bags with one hand and tears it off along the perforated tear line, and then rubs the mouth of the bag and opens the mouth with his/her fingers. If the plastic bag is used as a trash bag, the trash bag after being opened is put in a garbage can. In actual use, there are some shortcomings. (1) The garbage can occupies a lot of space. (2) The roll of bags also needs to be stored separately, which not only occupies a space but also brings management troubles to the user. The user easily forgets where the bags are stored, and sometimes it will be a waste of time to find the bags. (3) When the bag is used each time, a series of actions, such as tearing the bag off, opening the bag, and setting the bag, are required. This is troublesome.

SUMMARY OF THE INVENTION

In view of the shortcomings of the prior art, the primary object of the present invention is to provide a bag dispensing apparatus and a bag dispensing system. The bag dispensing apparatus provides a bag locking mechanism for locking or unlocking a bag retaining mechanism, so that a roll of bags can be stored in the bag dispensing apparatus and a leading bag of the roll of bags can be directly hanged on the bag dispensing apparatus for use. The storage and use of the bags are cleverly integrated to saves the space, and the operation is more convenient.

In order to achieve the above object, the present invention adopts the following technical solutions:

A bag dispensing apparatus comprises a housing, a bag retaining mechanism, and a bag locking mechanism. The housing has a bag outlet. The bag retaining mechanism is configured to retain a roll of bags. The bag retaining mechanism is rotatably mounted to the housing. The bag locking mechanism is mounted to the housing for selectively locking or unlocking the bag retaining mechanism. When the bag locking mechanism locks the bag retaining mechanism, the roll of bags cannot rotate along with the bag retaining mechanism. When the bag locking mechanism unlocks the bag retaining mechanism, the roll of bags can rotate along with the bag retaining mechanism.

A bag dispensing system comprises the above-mentioned bag dispensing apparatus and a roll of bags disposed in the housing of the bag dispensing apparatus. The roll of bags is positioned on the bag retaining mechanism and rotated synchronously with the bag retaining mechanism. The roll of bags has a plurality of continuously connected bags. A perforated tear line is arranged between every adjacent two of the bags. At least one side of each bag has an exposed mouth or a tearable mouth. The mouth is located between the tear lines at upper and lower ends of the bags. A leading bag of the bags selectively extends out from the bag outlet to expose the mouth. The leading bag is directly hung on the bag dispensing apparatus for storage use.

Compared with the prior art, the present invention has obvious advantages and beneficial effects. Specifically, it can be known from the above technical solutions:

1. With the bag locking mechanism, the bag dispensing apparatus has the functions of storing a roll of bags and directly hanging a leading bag of the roll of the bags for use after the leading bag extends out.

2. With the retraction mechanism, the bags can be retracted and wound inwardly from the bag outlet, so as to solve the problem that the bags extend out excessively. The bags can be partially or completely hidden in the housing as needed.

3. At least one side of each bag has an exposed mouth or a tearable mouth. The mouth is located between the tear lines at the upper and lower ends of the bags. After the leading bag extends out, the mouth of the leading bag serves as an entrance for objects to be placed into the leading bag. After placing the objects in the leading bag, the user can tear off the leading bag with the objects along the tear line at the upper end of the leading bag. The operation is convenient and practical.

The bag, the bag dispensing apparatus and the method using the same are especially suitable for occasions with small spaces such as vehicles.

DETAILED DESCRIPTION OF THE PREFERRED EMBODIMENTS

Figure 1:
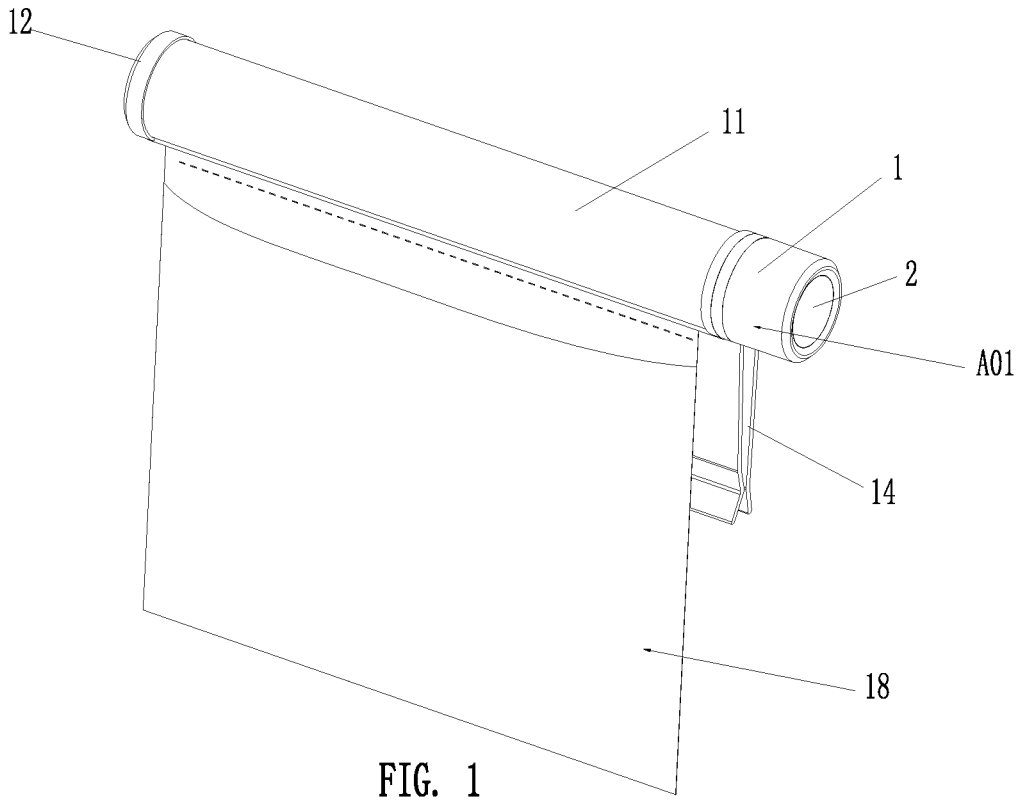
FIG. 1 is a front perspective view according to a first embodiment of the present invention (a push-type same-side retraction design)
Figure 2:
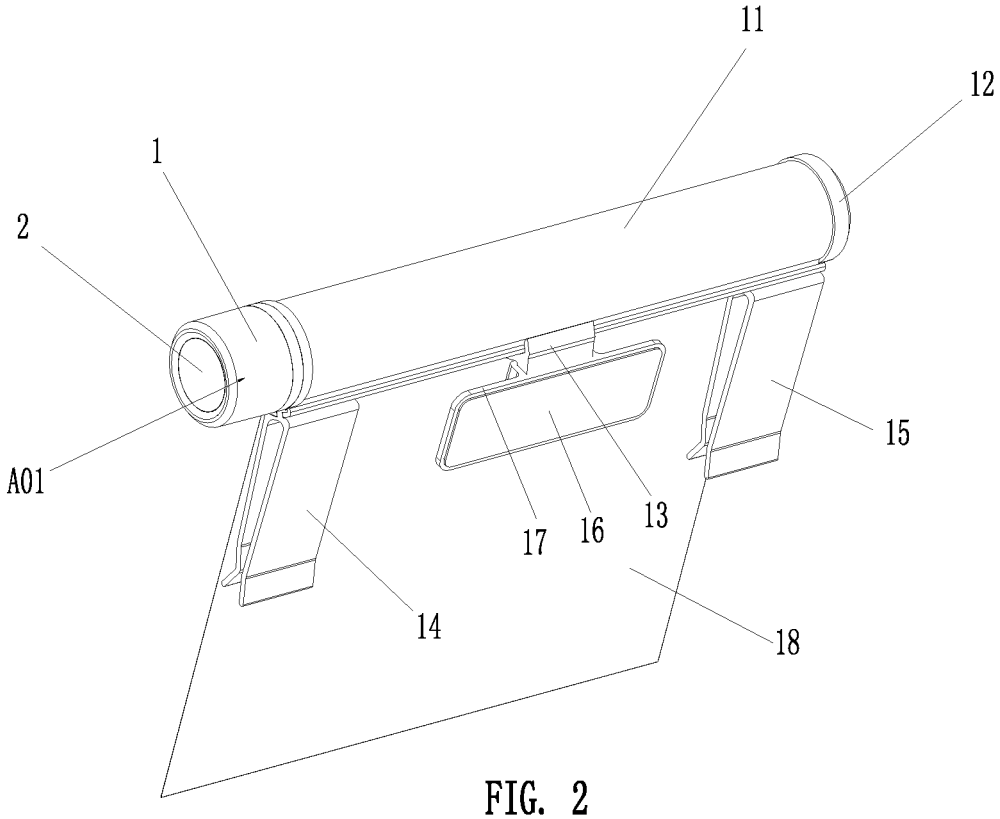
FIG. 2 is a rear perspective view according to the first embodiment of the present invention.
Figure 3:
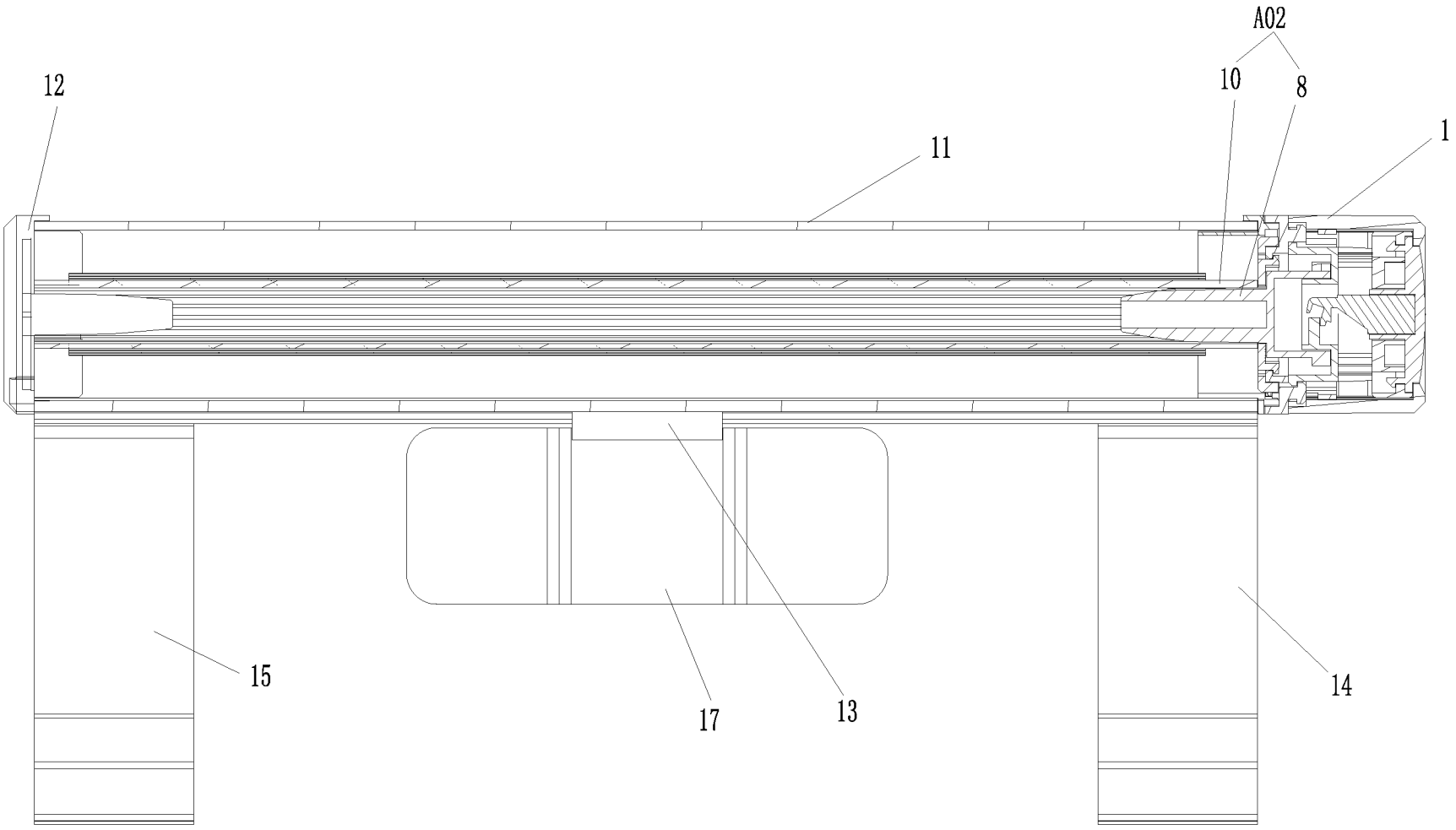
FIG. 3 is a cross-sectional view according to the first embodiment of the present invention.

Referring to FIG. 1 through FIG. 24, a specific structure in accordance with various embodiments of the present invention is shown.

A bag dispensing apparatus A01 comprises a housing, a bag retaining mechanism A02, and a bag locking mechanism A03. The housing has a bag outlet. The bag retaining mechanism A02 is configured to retain a roll of bags. The bag retaining mechanism A02 is rotatably mounted to the housing. The bag locking mechanism A03 is mounted to the housing for selectively locking or unlocking the bag retaining mechanism A02.

When the bag dispensing apparatus A01 is in use, a roll of bags is installed in the housing. The roll of bags has a plurality of continuously connected bags. When the bag locking mechanism A03 locks the bag retaining mechanism A02, the roll of bags cannot rotate along with the bag retaining mechanism A02. When the bag locking mechanism A03 unlocks the bag retaining mechanism A02, the roll of bags can rotate along with the bag retaining mechanism A02. In general, a perforated tear line is arranged between every adjacent two of the bags. At least one side of each bag has an exposed mouth or a tearable mouth. The mouth is located between the tear lines at the upper and lower ends of the bags. The housing has a cylindrical shape. One end of the housing has a roll core positioning end, and the other end of the housing is provided with the bag retaining mechanism A02 and the bag locking mechanism A03. The bags are generally arranged around a roll core. The bag retaining mechanism A02 includes a roll core retaining shaft. The roll core retaining shaft is inserted in the roll core so that the roll of bags is positioned in the housing. The bag locking mechanism A03 is configured to lock the bag retaining mechanism A02 (the roll core retaining shaft) to prevent the bag retaining mechanism A02 from rotating. In this way, a leading bag of the roll of bags can be pulled outwardly and directly hanged on the bag dispensing apparatus A01 for use. Articles, garbage, etc. can be put into the leading bag from the mouth of the leading bag, and then the leading bag can be torn off to be taken away with the articles in the leading bag. There is no need to tear off the leading bag and put it in a garbage can like the traditional way. When the next bag is needed, the bag locking mechanism A03 unlocks the bag retaining mechanism A02. The unlocking operation can be done in many ways. For example, the bag locking mechanism A03 is controlled by a trigger to unlock the roll core retaining shaft. For some bag locking mechanisms A03 with contact resistance, in a natural state, the leading bag is in a normal load-bearing state. When there is no other external force, the resistance generated by the bag locking mechanism A03 on the roll core retaining shaft can prevent the roll core retaining shaft from rotating. When a pulling force exerted by the user on the leading bag is greater than a set value, the resistance can be offset and the leading bag can be pulled outwardly from the bag outlet. Therefore, the manual pulling force of the user serves as an unlocking manner.

Preferably, the present invention further comprises a retraction mechanism. The retraction mechanism includes a retraction rotating portion. The retraction rotating portion links the bag locking mechanism A03 and the bag retaining mechanism A02 to rotate reversely so that the roll of bags can be retracted inwardly from the bag outlet. When a leading bag of the bags is pulled outwardly from the bag outlet, the bag retaining mechanism A02 rotates forward. The retraction mechanism and the bag locking mechanism A03 are arranged on the same side or the opposite sides of the housing.

FIGS. 1 to 7 show the specific structure of a first embodiment of the present invention, which is a push-type same-side retraction design.

The housing 11 has an accommodating chamber therein. One side of the housing 11 has a bag outlet 103 communicating with the accommodating chamber. One end of the housing 11 has a roll core positioning end, and the other end of the housing 11 has an opening. A roll core retaining shaft 8 and a button 2 are disposed at one end of the housing 11 corresponding to the opening. The button 2 has a pressing portion exposed at the opening. The roll core retaining shaft 8 is configured to position the roll of bags. The roll core retaining shaft 8 is rotatably installed in the housing 11. The button 2 has a first rotation limiting portion. When the button 2 is pressed, the first rotation limiting portion will form a stop on the rotation circumference of the bag retaining mechanism A02. When the button 2 is pressed again, the first rotation limiting portion releases the stop on the rotation circumference of the bag retaining mechanism A02. The roll core retaining shaft 8 has a first circumferential stop portion 81. The button 2 has a second circumferential stop portion 21. When the button 2 is pressed, the second circumferential stop portion 21 is engaged with the first circumferential stop portion 81, so that the roll core retaining shaft 8 is locked and cannot be rotated. When the button 2 is pressed again, the second circumferential stop portion 21 is disengaged from the first circumferential stop portion 81 to unlock the roll core retaining shaft 8.

One end or the other end of the housing 11 is provided with the retraction mechanism. The retraction mechanism includes a retraction rotating portion. The retraction rotating portion is rotatably installed relative to the housing 11.

When the button 2 locks the roll core retaining shaft 8, the retraction rotating portion links the roll core retaining shaft 8 and the button 2 to rotate synchronously and reversely so that so that the roll of bags can be retracted inwardly from the bag outlet 103. When the leading bag is pulled outwardly from the bag outlet 103, the roll core retaining shaft 8 rotates forward. The housing 11 is provided with an annular elastic portion 62 matching the retraction rotating portion. The annular elastic portion 62 has a plurality of elastic protrusions 621 arranged in the circumferential direction. The retraction rotating portion is sleeved on the annular elastic portion 62. Under the action of an external force, the retraction rotating portion is rotatably arranged along the annular elastic portion 62.

Figure 4:
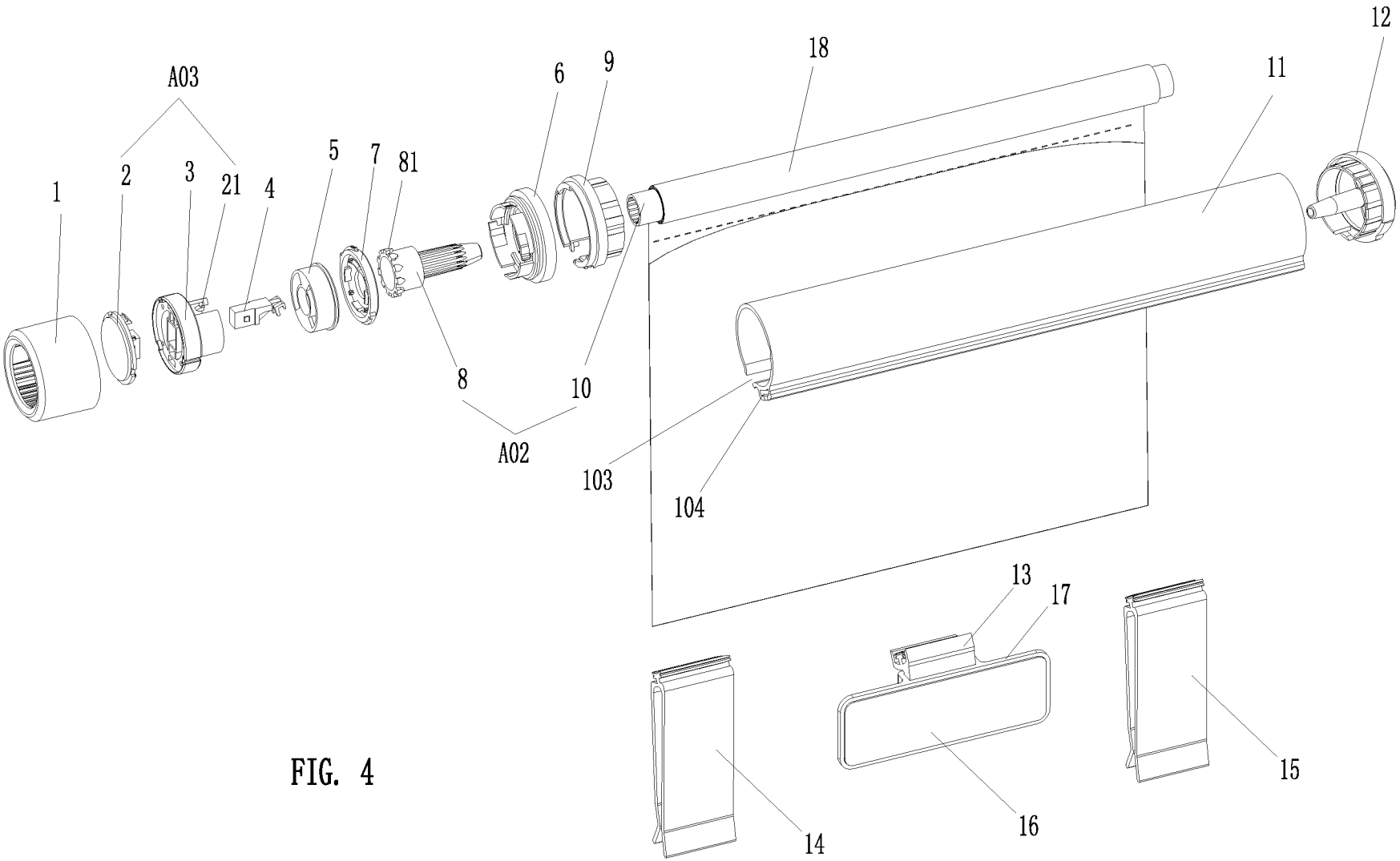
FIG. 4 is an exploded view according to the first embodiment of the present invention.
Figure 7:
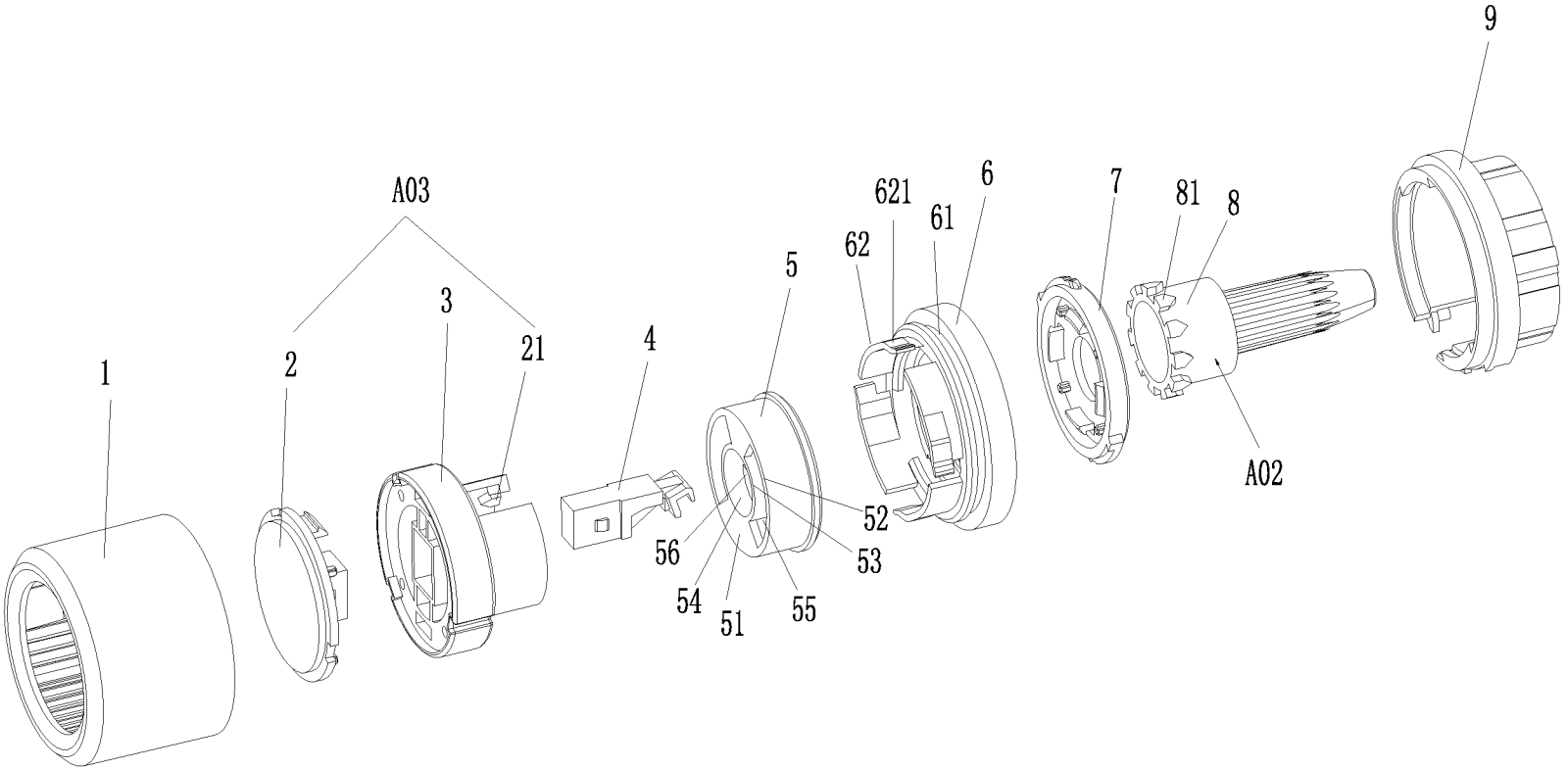
FIG. 7 is a partial exploded view according to the first embodiment of the present invention.

The first embodiment, as shown in FIG. 4 and FIG. 7, comprises a rotary cap 1, a button 2, a button sleeve 3, a self-locking switch 4, a self-locking limiter 5, an outer cover 6, an inner cover 7, and a roll core retaining shaft 8, a connection fixing member 9, a roll core 10, a housing 11, a housing end cover 12, a middle back clip 13, a right back clip 14, a left back clip 15, adhesive 16, and a fastener 17. The bags 18 are wound around the roll core 10. The retraction rotating portion refers to the rotary cap 1. When assembling, the housing end cover 12 is mounted to one end of the housing 11, and the connection fixing member 9 is mounted to the other end of the housing 11. In actual design, the housing end cover 12, the housing 11 and the connection fixing member 9 may be designed to be an integral housing. The other end of the housing is formed with an opening for installing the roll core retaining shaft and the button. The roll of bags 18 with the roll core 10 is installed in the housing. One end of the housing is provided with the roll core retaining shaft 8 and the bag locking mechanism A03. The button 2 is pressed to link the bag locking mechanism A03 for locking or unlocking the bag retaining mechanism A02. Specifically, the button 2, the button sleeve 3 and the self-locking switch 4 are assembled to form a pressing assembly. The pressing assembly is mounted in the rotary cap 1 and can be horizontally pressed and displaced along the rotary cap 1. The end face of the button 2 is exposed at the outer end of the rotary cap 1. The second circumferential stop portion 21 is formed on the inner wall of the button sleeve 3. The first circumferential stop portion 81 is formed on the outer wall of the roll core retaining shaft 8.

Figure 5:
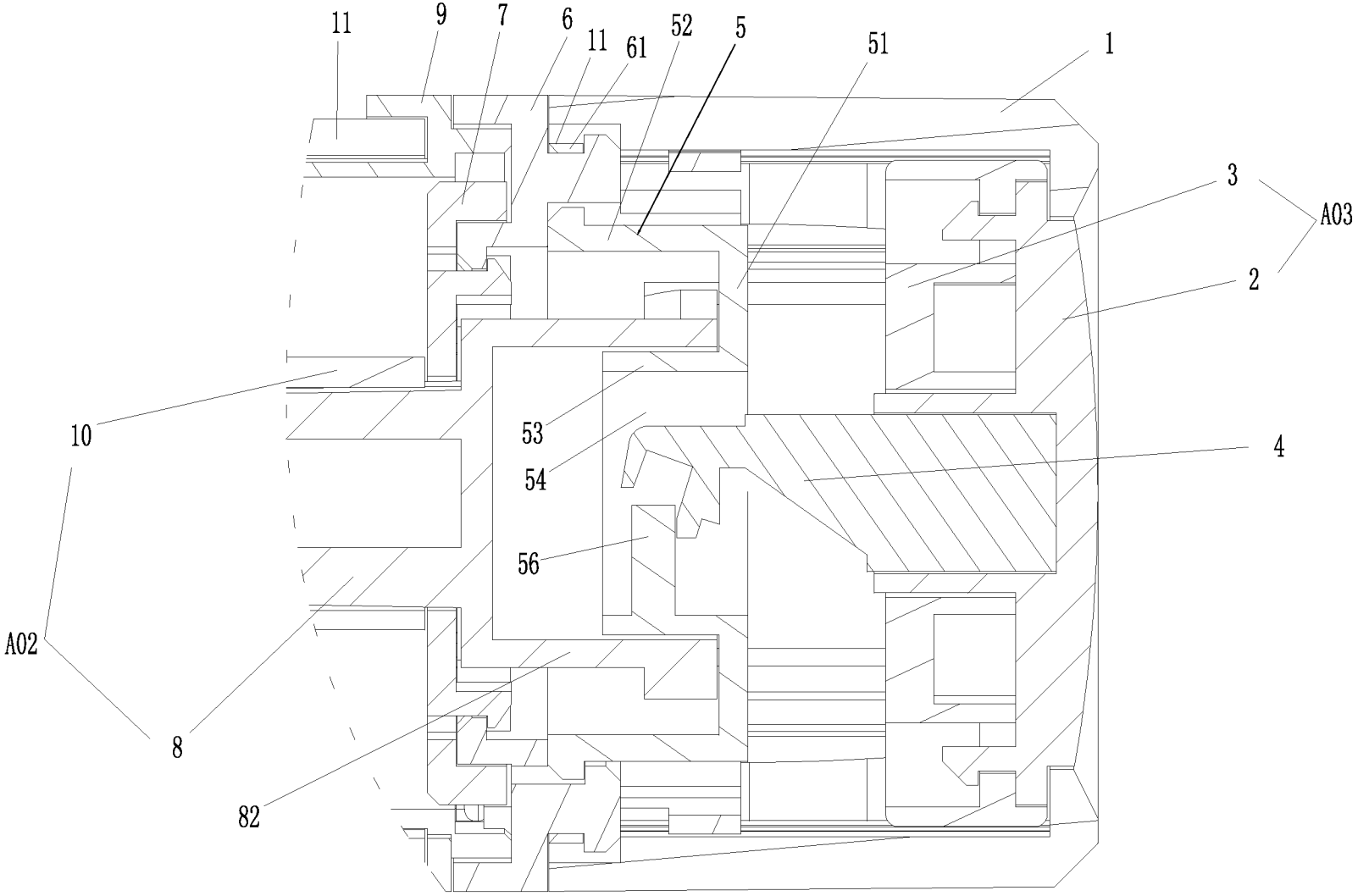
FIG. 5 is a partial cross-sectional view according to the first embodiment of the present invention (in a locked state)
Figure 6:
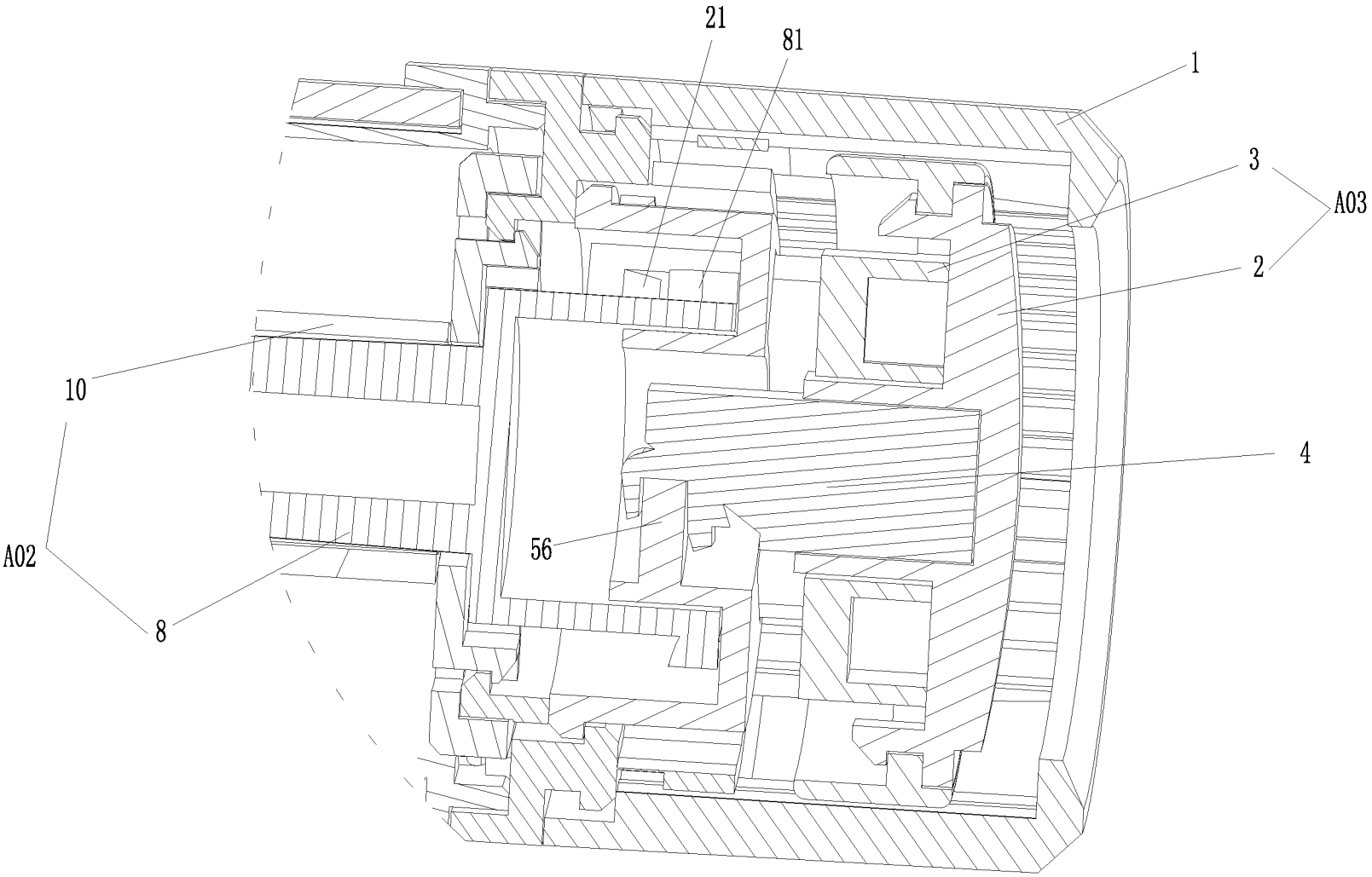
FIG. 6 is a partial cross-sectional view according to the first embodiment of the present invention (in an unlocked state)

As shown in FIG. 5, the self-locking switch 4 has an elastic jaw. In the locked state, the self-locking switch 4 is in a natural state, and the elastic jaw is deviated from the self-locking limiter 5. As shown in FIG. 6, when the button 2 is pressed, both the button sleeve 3 and the self-locking switch 4 are displaced in the pressing direction, and the second circumferential stop portion 21 is disengaged from the first circumferential stop portion 81 to release the locking. The elastic jaw of the self-locking switch 4 is deformed by pushing the self-locking limiter 5, and the elastic jaw is engaged with the self-locking limiter 5. As shown in FIG. 5, the button 2 is pressed again and then released. The self-locking switch 4 is elastically returned to drive the button sleeve 3 and the button 2 to return. The second circumferential stop portion 21 is engaged with the first circumferential stop portion 81.

The self-locking limiter 5 has an end plate 51, an annular outer wall 52 and an annular inner wall 53 connected to the end plate 51. The annular outer wall 52 is arranged around the annular inner wall 53. The end plate 51 is formed with a first hole 54 corresponding to the area surrounded by the annular inner wall 53 and a second hole 55 corresponding to the area surrounded by the annular inner wall 53 and the annular outer wall 52. The inner side of the annular inner wall 53 is provided with a self-locking limiting portion 56. The self-locking switch 4 is inserted through the first hole 54 to be selectively mated with the self-locking limiting portion 56. The button sleeve 3 is inserted into the second hole 55 between the annular inner wall 53 and the annular outer wall 52. The end of the roll core retaining shaft 8 has an annular end wall 82. The first circumferential stop portion 81 is formed on the outer surface of the annular end wall 82. The annular end wall 82 matches the periphery of the annular inner wall 53 and is located between the annular inner wall 53 and the annular outer wall 52. One end of the annular end wall 82 is limited by the end plate 51.

The annular outer wall 52 of the self-locking limiter 5 is assembled to the outer cover 6. The outer cover 6 has an annular groove 61 and the annular elastic portion 62. The outer cover 6 is assembled and fixed to the connection fixing member 9. The inner cover 7 is assembled to the outer cover 6. The inner cover 7 is fitted to the other end of the annular end wall 82. The outer cover 6, the inner cover 7, the connection fixing member 9, the housing 11 and the housing end cover 12 are assembled to each other and positioned as a relative fixed portion. The structure of the self-locking limiter 5 is relatively ingenious, which takes into account the assembly and positioning of the annular end wall 82, the button sleeve 3 and the self-locking switch 4. The structure is compact. The rotary cap 1 serves as the retraction rotating portion, of course, it also serves as the outer covering portion of the bag locking mechanism A03. The inside of the rotary cap 1 is hollow, and both ends of the rotary cap 1 pass through the rotary cap 1. One end of the rotary cap 1 has a protruding rib 11 to be fitted in the annular groove 61, thereby preventing the rotary cap 1 from disengaging from the outer cover 6. The inner wall of the rotary cap 1 is provided with guide bars extending horizontally to be fitted with guide grooves of the outer periphery of the button sleeve 3, so that the button sleeve 3 can be moved along the guide bars when the button is pressed. Through the cooperation of the guide bars and the guide grooves, when the rotary cap 1 is rotated, it can synchronously drive the button sleeve 3, the button 2, the self-locking switch 4, the self-locking limiter 5 and the roll core retaining shaft 8 to rotate together. The arrangement of the elastic protrusions 621 makes the rotary cap 1 unable to rotate in a natural state. An external force (for example, the user manually rotates the rotary cap) is needed to overcome the elastic force of the elastic protrusions 621 for rotating the rotary cap 1.

As shown in FIGS. 1 to 4 and FIG. 13, the housing is connected with an installation positioning portion for installing the entire bag dispensing apparatus A01. The outer side of the housing has a connecting groove 104 extending along the housing. The connecting groove 104 has two end notches and a lower notch. A first back clip and/or a second back clip are provided. The first back clip is fitted to the two inner wall surfaces in the connecting groove. The second back clip is fitted to the inner and outer wall surfaces in the connecting groove. Specifically, the first back clip refers to the middle back clip 13, and the second back clip refers to the right back clip 14 and the left back clip 15. In the actual design, either the first back clip or the second back clip can be selected or both. The housing 11, the middle back clip 13, the right back clip 14, the left back clip 15, the housing end cover 12 and the connection fixing member 9 may be produced as a whole. Therefore, the installation positioning portion may be integrally formed with the housing or separately disposed on the housing. The adhesive 16 is disposed on the back of the fastener 17. The fastener 17 is disposed on the middle back clip 13. The adhesive 16 can be adhered and located at a suitable position (usually a smooth plane). The right back clip 14 and the left back clip 15 each have a clip-on structure, which can be clipped at a suitable position to achieve positioning. The installation positioning portion is not limited to the arrangement of these parts, and other feasible installation structures (magnetic positioning, etc.) can be used, as long as the entire bag dispensing apparatus A01 can be positioned or placed.

Figure 8:
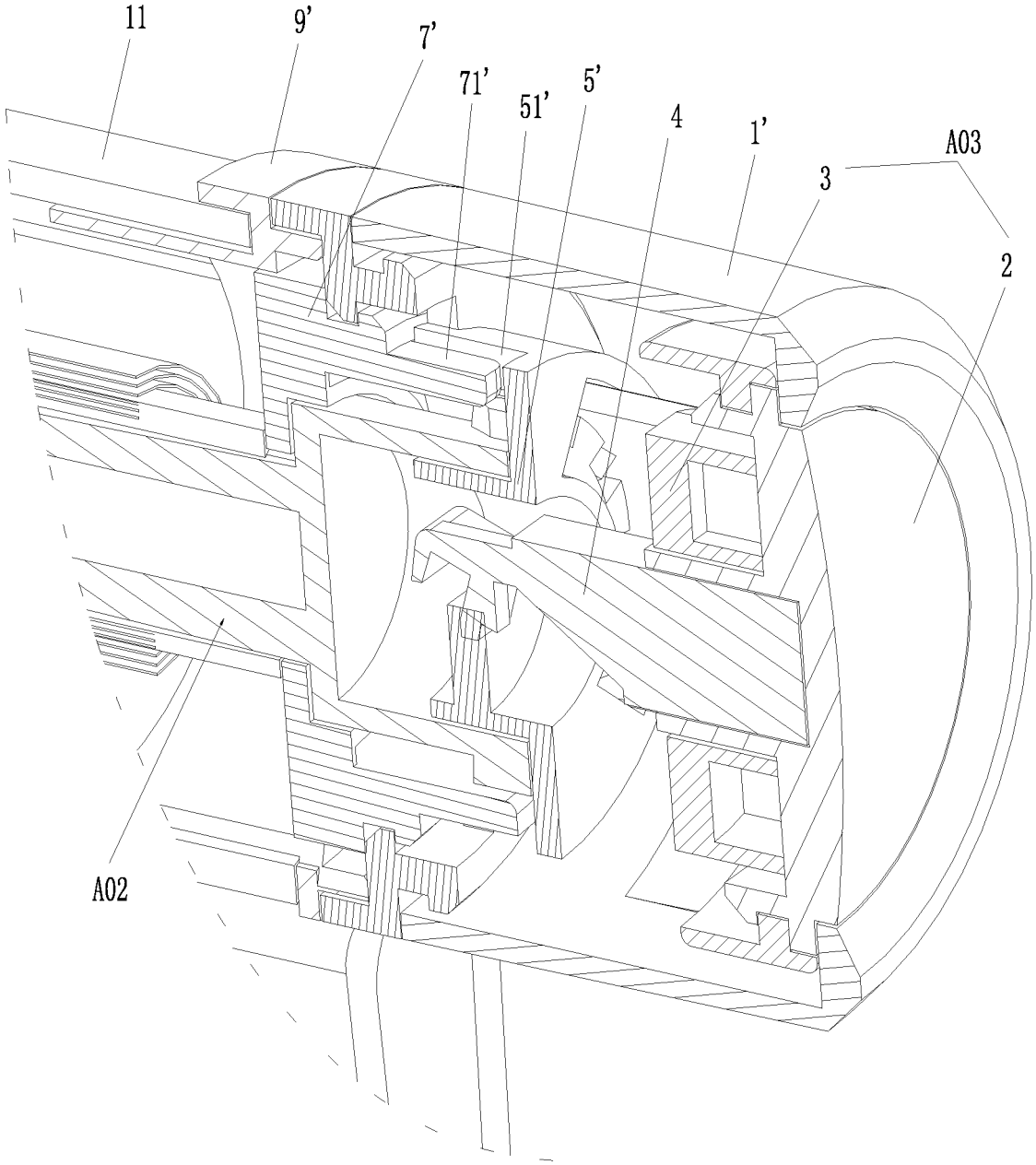
FIG. 8 is a partial cross-sectional view according to a second embodiment of the present invention (a push-type non-retraction design)
Figure 9:
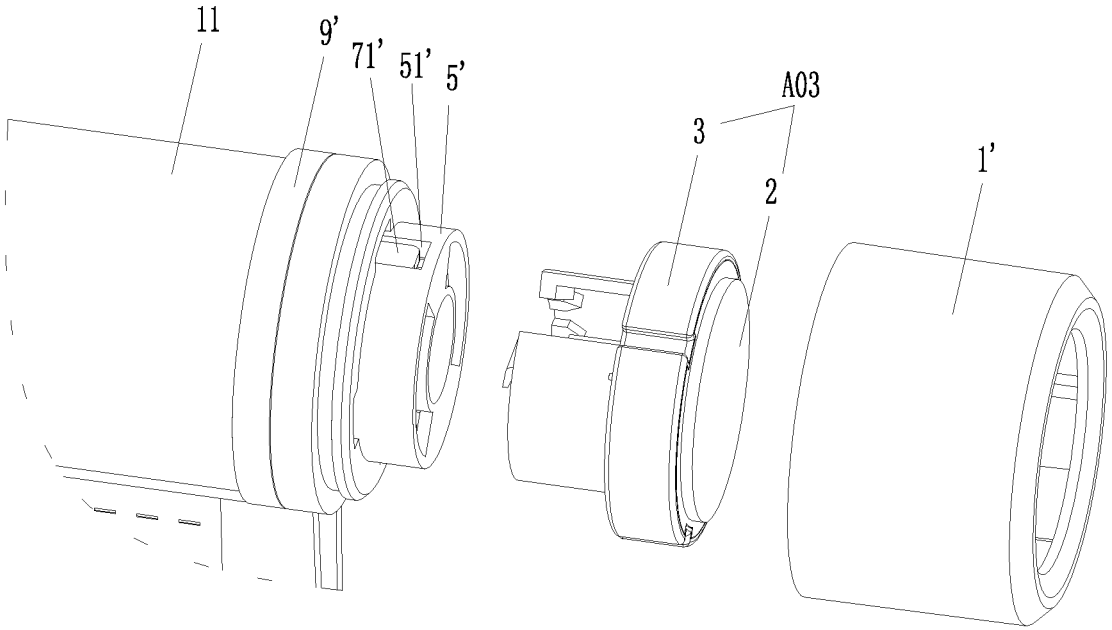
FIG. 9 is a partial exploded view according to the second embodiment of the present invention (a push-type non-retraction design)

FIG. 8 and FIG. 9 show the specific structure of a second embodiment of the present invention, which is a push-type non-retraction design.

The second embodiment is substantially similar to the first embodiment with the exceptions described hereinafter. The button 2, the button sleeve 3, the self-locking switch 4, the self-locking limiter 5' and the inner cover 7' cannot rotate through a rotation limitation structure. The cap 1' is sleeved onto the periphery of the button 2, the button sleeve 3, the self-locking switch 4 and the self-locking limiter 5'. The cap 1' is rotatable relative to the self-locking limiter 5'. Therefore, even if an external force is applied to the cap 1' during operation, the cap 1' rotates idly, so that the purpose of reversely rotating the roll core retaining shaft 8 cannot be achieved. The button 2, the button sleeve 3, the self-locking switch 4 are assembled and connected into one. The button sleeve 3 extends into the second hole of the self-locking limiter 5' to prevent mutual rotation. The self-locking limiter 5' is formed with a slot 51' for receiving an extension portion 71' of the inner cover 7' to prevent mutual rotation. The inner cover 7' can rotate relative to the connection fixing member 9'.

Figure 10:
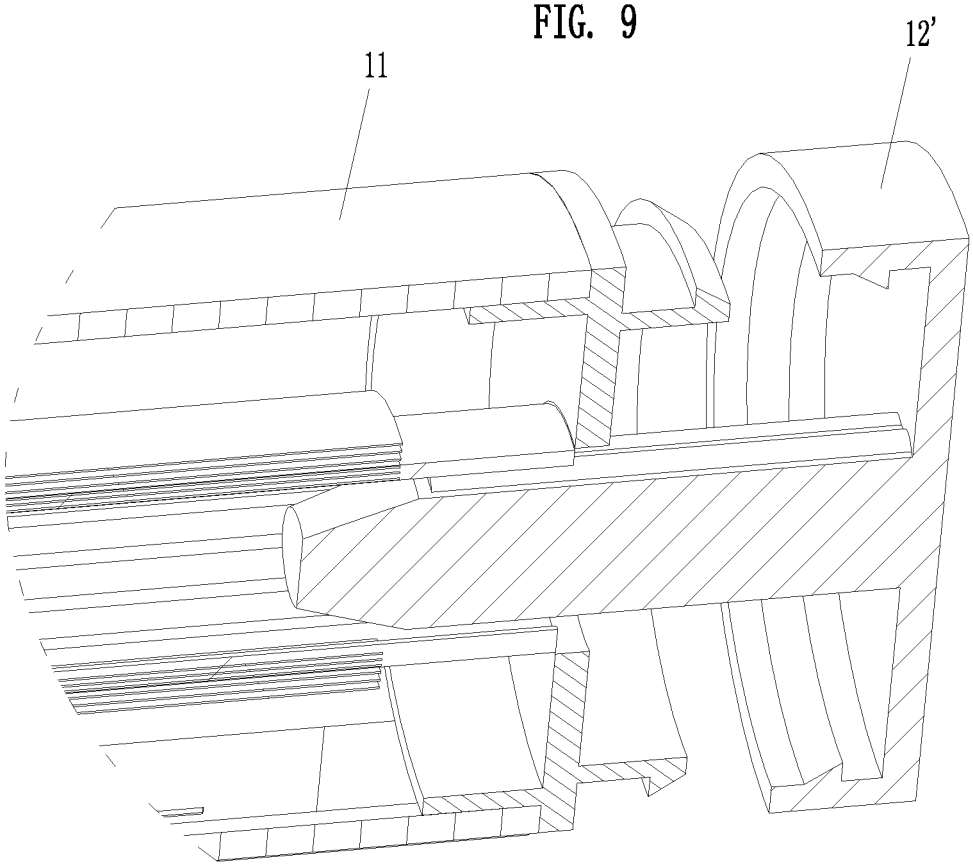
FIG. 10 is a partial cross-sectional view according to a third embodiment of the present invention (a push-type opposite-side retraction design.)

FIG. 10 shows the specific structure of a third embodiment of the present invention, which is a push-type opposite-side retraction design. The retraction mechanism and the bag locking mechanism A03 are disposed on two opposite sides of the housing. When the bag lock mechanism unlocks the bag retaining mechanism A02, the retraction rotating portion links the bag retaining mechanism A02 to rotate reversely so that the roll of bags can be retracted inwardly from the bag outlet.

The third embodiment is substantially similar to the second embodiment with the exceptions described hereinafter. The housing end cover of the housing 11 is changed to a retraction knob 12'. The retraction knob 12' is rotatably installed relative to the housing 11. The retraction knob 12' extends into the accommodating chamber inside the housing 11 and provides a roll core positioning end. The roll core positioning end is an insertion section, which is tightly fitted in one end of the roll core. In this way, when the retraction knob 12' is turned reversely, the bags can be retracted. During the reverse operation, the roll core, the roll core retaining shaft 8, the button 2, the button sleeve 3, the self-locking switch 4, the self-locking limiter 5' and the inner cover 7' rotate together relative to the connection fixing member 9'. The retraction knob 12' can be directly installed on the end of the housing 11. Alternatively, by installing a fixed connecting member on the end of the housing 11, the retraction knob 12' is installed on the fixed connecting member.

Figure 11:
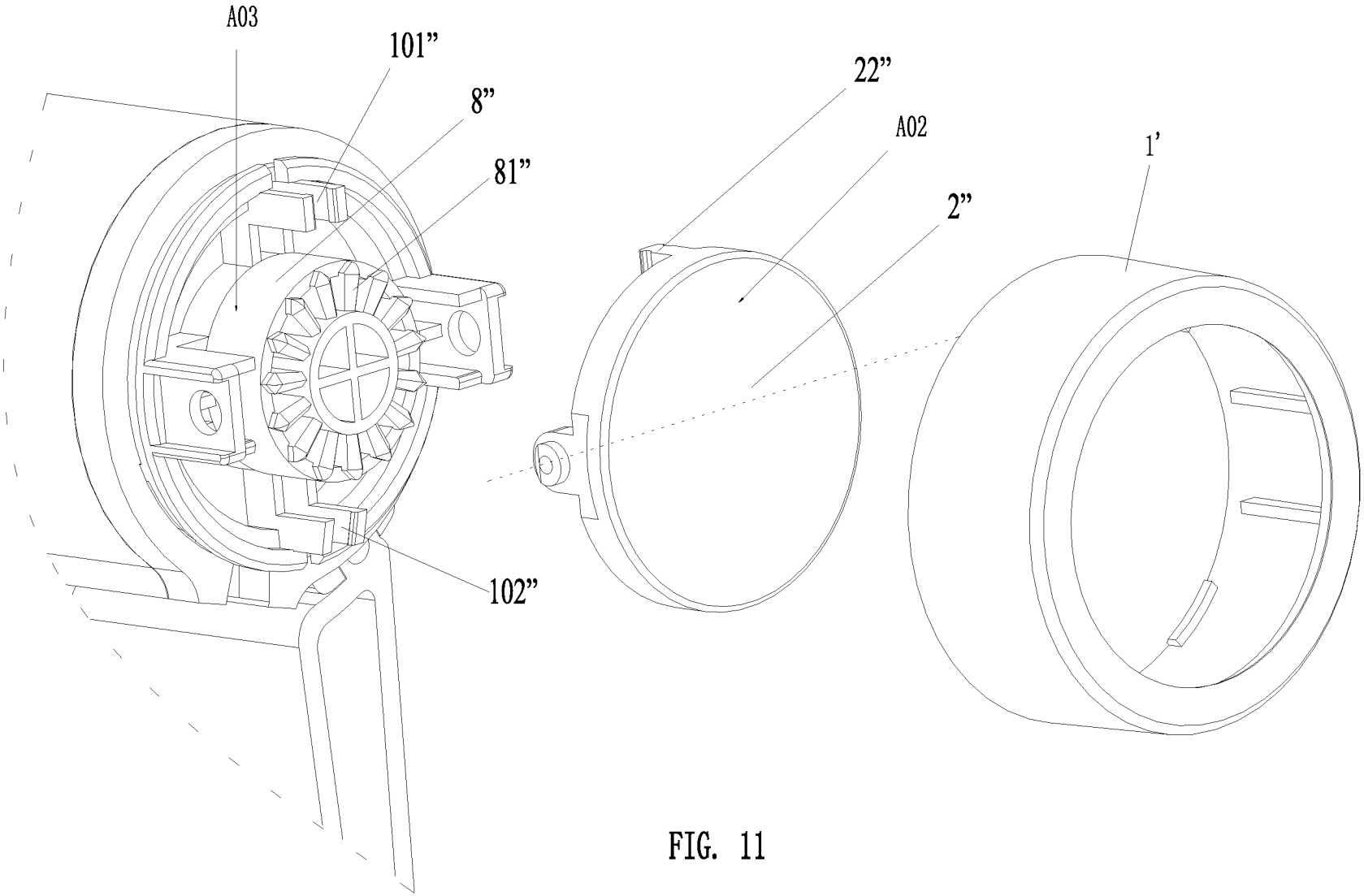
FIG. 11 is a partial exploded view according to a fourth embodiment of the present invention (an inclined button non-retraction design)
Figure 12:
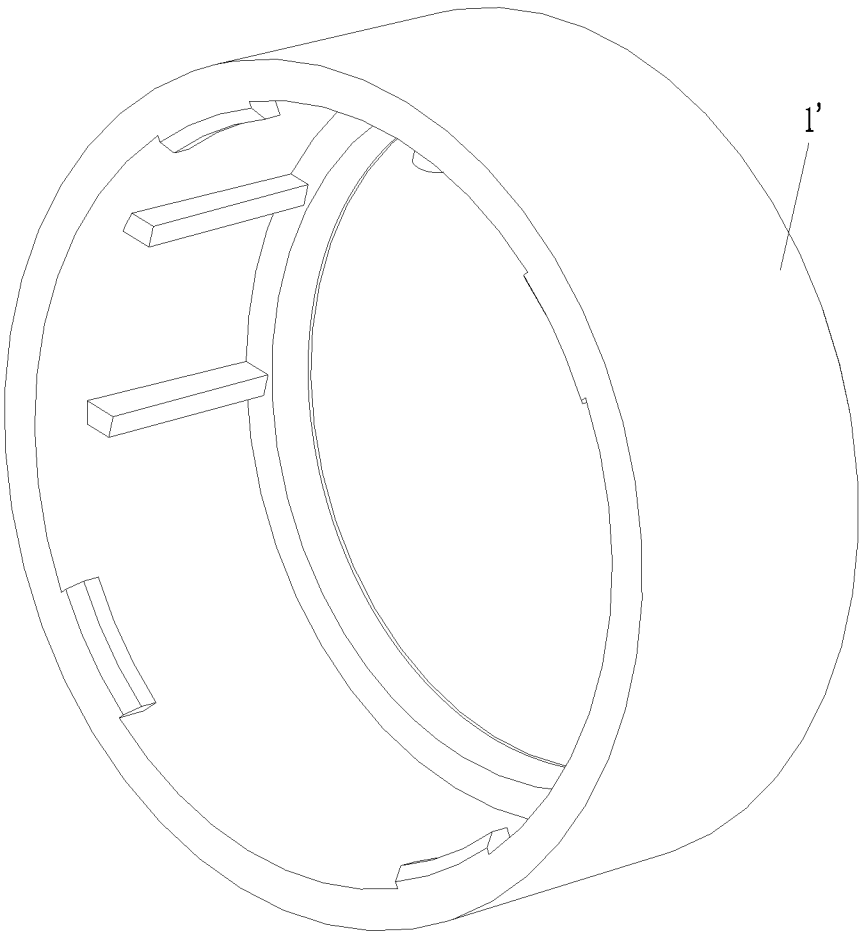
FIG. 12 is another partial exploded view according to the fourth embodiment of the present invention (an inclined button non-retraction design)
Figure 12:
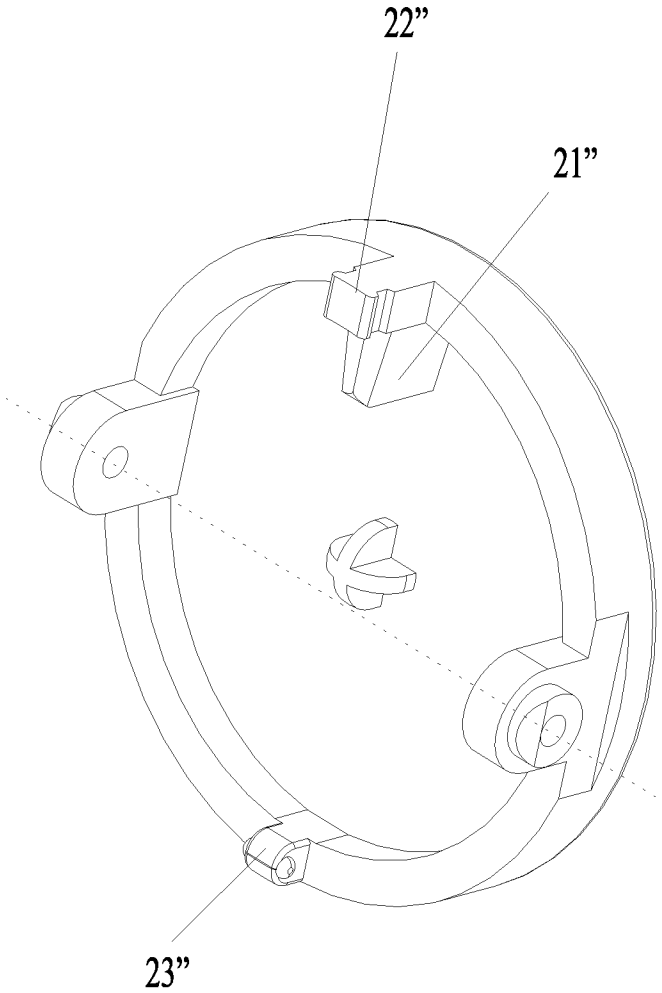
Figure 13:
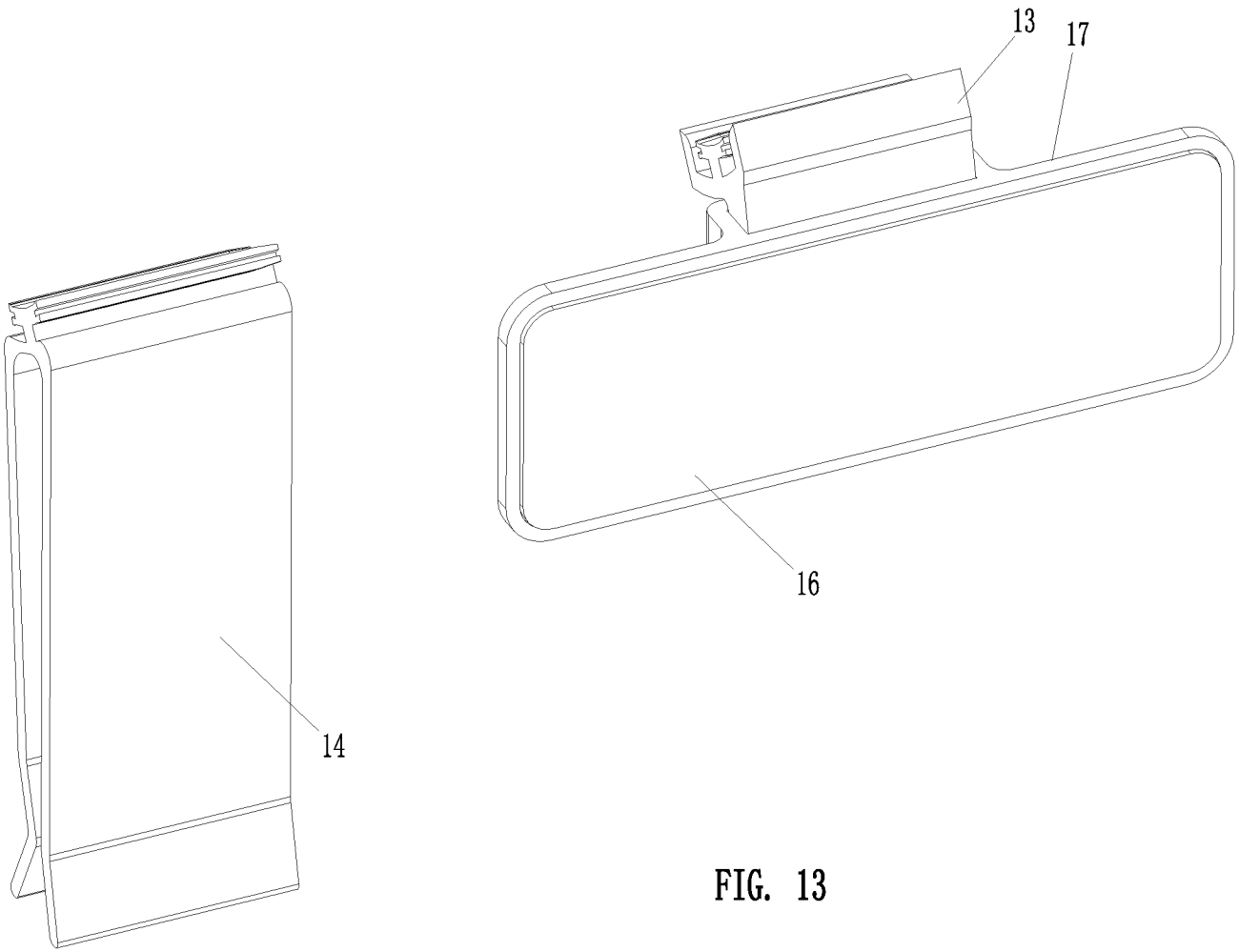
FIG. 13 is a perspective view of the installation positioning portion according to the first embodiment of the present invention.

FIG. 11 and FIG. 12 show the specific structure of a four embodiment of the present invention, which is an inclined button.

The fourth embodiment is substantially similar to the first embodiment with the exceptions described hereinafter. The main difference between the fourth embodiment and the first embodiment is the bag locking mechanism A03. The button 2" is tilted relative to an axis. The second circumferential stop portion 21" is arranged on the inner side of the button 2" corresponding to the axis. When one side of the button 2" is pressed, the button 2" is deflected along one side, and the second circumferential stop portion 21" is engaged with the first circumferential stop portion 81" to lock the roll core retaining shaft 8. When the other side of the button 2" is pressed, the button 2" is deflected along the other side, and the second circumferential stop portion 21" is disengaged from the first circumferential stop portion 81" to unlock the roll core retaining shaft 8. The first circumferential stop portion 81" is formed on the end face of the roll core retaining shaft 8". A first positioning buckle 22" is provided on one side of the inner periphery of the button 2" corresponding to the first circumferential stop portion. A second positioning buckle 23" is provided on the opposing side of the inner periphery of the button 2" corresponding to the first positioning buckle 22". The housing is formed with a first positioning slot 101" and a second positioning slot 102". When the button 2" is pressed, one of the first positioning buckle 22" and the second positioning buckle 23" is engaged with the corresponding positioning slot, and the other of the first positioning buckle 22" and the second positioning buckle 23" is disengaged from the corresponding positioning slot.

Similarly, as shown in the third embodiment, thee housing end cover or the retraction knob can be provided at the end of the housing 11 as needed to realize a non-retraction structure or an opposite-side retraction structure.

Figure 14A:
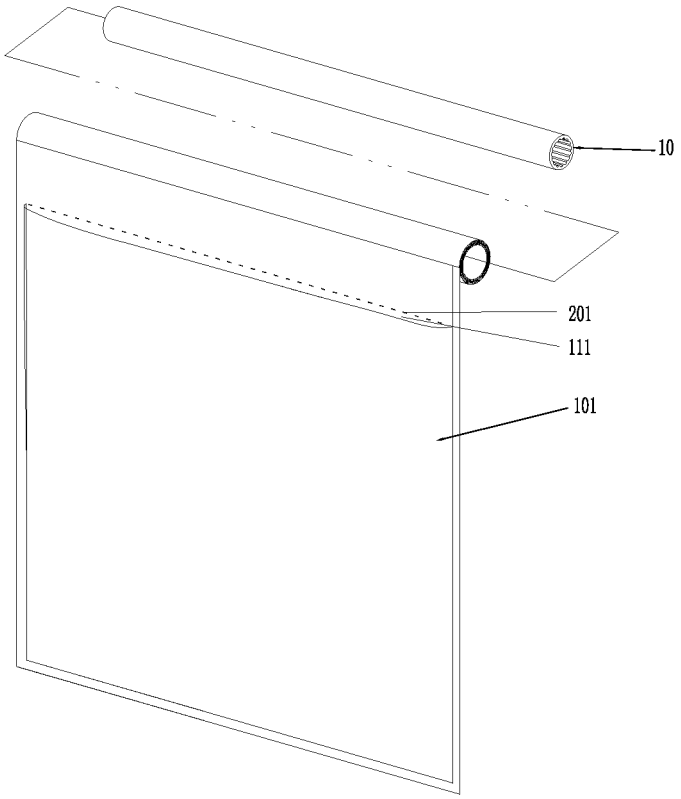
FIG. 14*a* is an exploded view of the roll of bags according to a fifth embodiment of the present invention (including the roll core)
Figure 15:
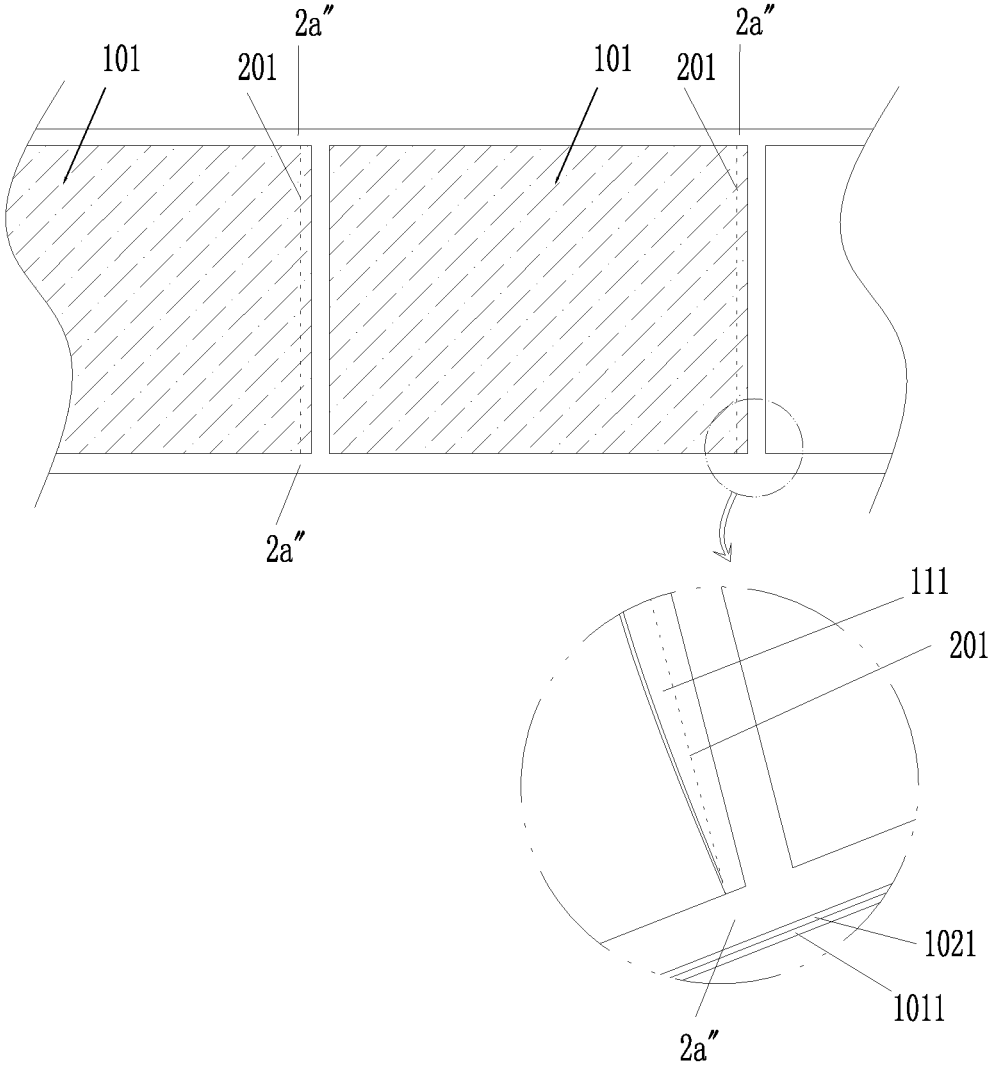
FIG. 15 is a diagram of another manufacturing structure of the bags shown in FIG. 14*a;*

FIG. 14*a* and FIG. 15 show the structure of the bags of a fifth embodiment. Of course, the various bag dispensing apparatuses listed in this description can be equipped with such bags. The bags are in the form a roll of bags, including a plurality of bags 101 continuously connected to form a roll. Generally, the continuously connected bags are wound around the roll core 10 to form a roll of bags. At least one end of the roll core 10 has an assembly cavity. The roll core 10 is a hollow roll core. The hollow portion passes through the left and right ends of the roll core 10. The inner wall of the assembly cavity has a plurality of concavities and convexities to facilitate tight fit. Of course, the roll core may be partially hollow, that is, only both ends of the roll core are hollow.

A perforated tear line 201 is arranged between every adjacent two of bags 101. At least one side of each bag 101 has an exposed mouth 111 or a tearable mouth. The mouth 111 faces upward. The bag 101 may have one mouth 111 or more than two mouths 111. Each mouth 111 extends downward to communicate with an accommodating space, or two or more mouths 111 each extend downward to communicate with an accommodating space. When arranging the mouths 111, two or more mouths 111 are arranged side by side or spaced up and down. Of course, they may be arranged on the left and right and spaced up and down. The left and right mouths and the upper and lower mouths may be slightly offset, not limited to being aligned with each other.

Figure 14B:
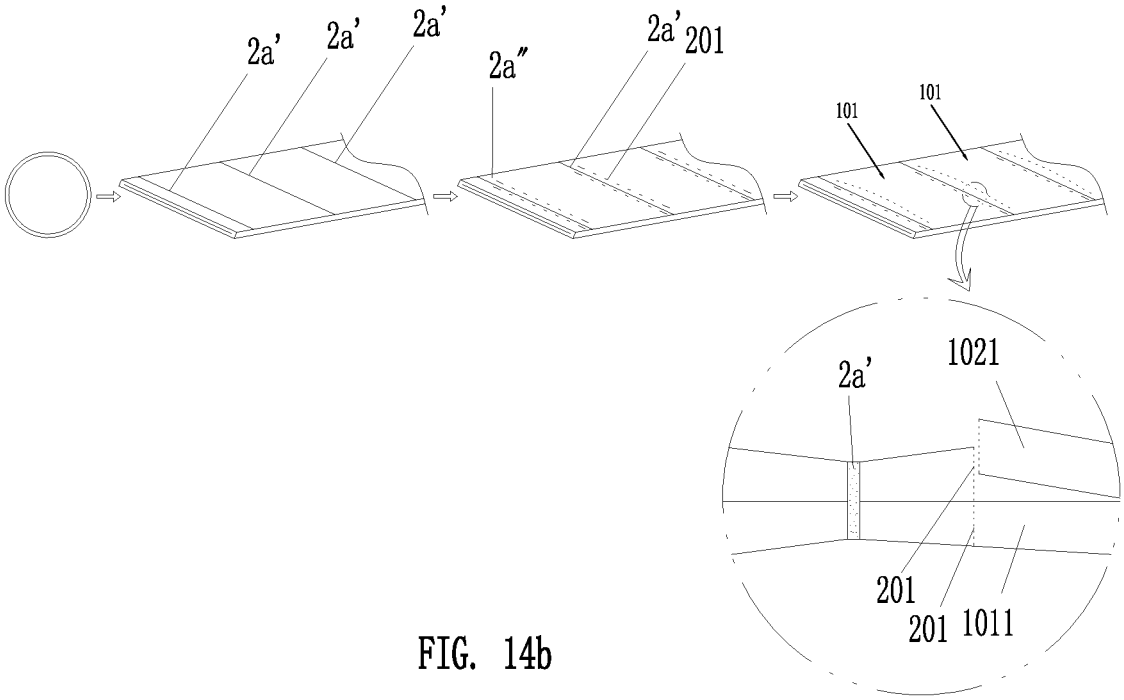
FIG. 14*b* is a diagram showing the change in the manufacturing process of the bags shown in FIG. 14*a;*

As shown in FIG. 14*b*, the left and right ends of the tear line 201 and the corresponding left and right ends of the bag 101 have a continuous connecting portion 2*a*". Specifically, the plurality of bags 101 continuously connected to form a roll have a front film 1021 and a rear film 1011 that are stacked. The left and right sides of the front film 1021 and the rear film 1011 are connected. A number of sealing lines 2*a*' are arranged at intervals along the length of the front film 1021 and the rear film 1011. The tear line 201 is located below the sealing line 2*a*'. The tear line 201 is formed on the front film 1021 and the rear film 1011. The tear line 2 on the front film 1021 is opened to form the mouth 111. The tear line 201 does not extend to the left and right ends of the front film 1021 and the rear film 1011. Between two adjacent bags 101, the two ends of the mouth 111 of the front film 1021 form a connection, and the tear line 2 of the rear film 1011 and the two ends of the tear line 201 form a connection. When producing, a hollow film is first sleeved on a cylinder to form a bag body. Then, the bag body is flattened, and the sealing lines 2*a*' and the tear lines 201 are formed on the bag body in sequence. The tear lines 201 are perforated tear lines. Then, the perforated tear line of the front film 1021 is torn and opened to form the mouth 111. Therefore, the mouth 111 is flush with the tear line 201.

For the manufacturing method of the first embodiment, if more than two mouths 111 arranged side by side are required, when making the sealing line 2*a*', a separation line is formed between two adjacent mouths. After the mouths 111 are opened, the plurality of mouths 111 can communicate with different accommodating spaces.

FIG. 15 shows another production structure of the bags 101. During production, the front film 1021 and the rear film 1011 are laminated and bonded by hot pressing, mainly suitable for plastic bags, etc. The material of the bags is not limited. A material that can be wound may be selected, such as a flexible material. The connection area of the front film 1021 and the rear film 1011 is a plurality of pressing rings (for example, rectangular rings, or rings with other shapes) connected in sequence. Then, a perforated tear line 201 is formed close to the upper end in the area enclosed by the pressing rings. The tear line 201 usually penetrates through the front film 1021 and the rear film 1011. The tear line 201 of the front film 1021 is torn to form the mouth 111. (The perforated tear line of the rear film 1011 is not torn. Between two adjacent bags 101, both sides are completely connected by pressing to form a continuous connecting portion 2*a*". In this way, the production process is simple and suitable for mass production. The pressing rings ensure reliable connection around the bags 101. When a leading bag of the bags 101 is hanged for use, the connection strength is further strengthened by pressing on both sides, the force is balanced, and the use is safe. When the bag 101 needs to be torn off, since only both narrow sides are completely connected, most of the middle area is connected by the perforated tear line, which is easy to tear and remove.

Figure 16:
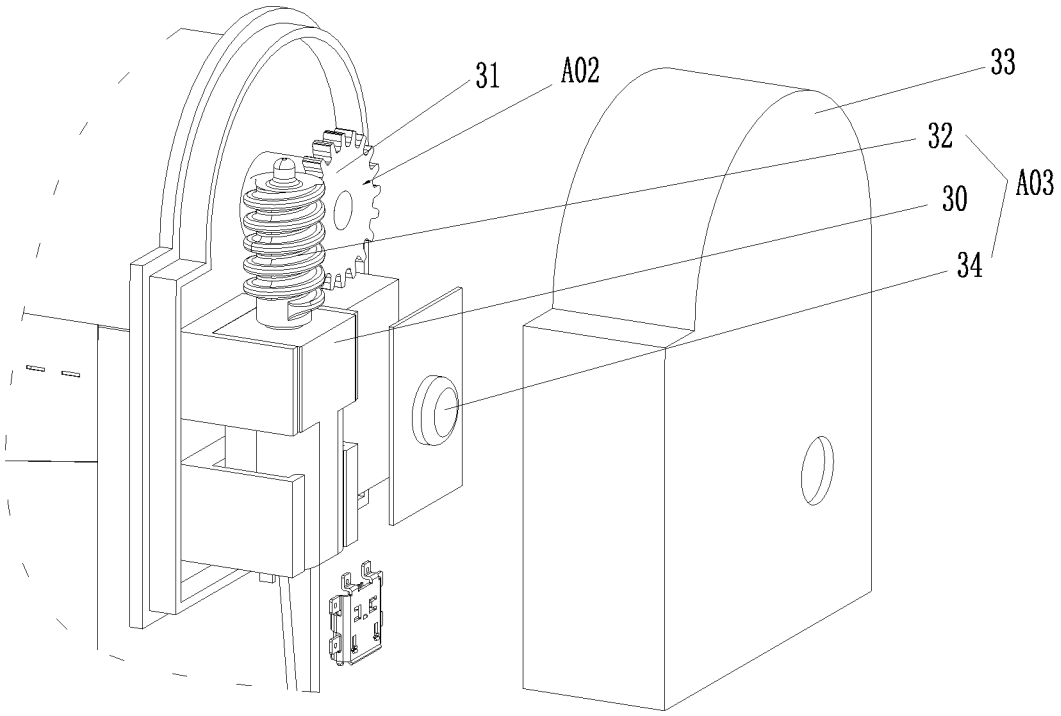
FIG. 16 is a partial exploded view according to a sixth embodiment of the present invention (an electric design)

FIG. 16 shows the specific structure of a sixth embodiment, which is an electric design. The main difference between the sixth embodiment and the first embodiment is the bag locking mechanism A03.

The bag locking mechanism A03 includes a motor 30. When the motor 30 is actuated, the bag retaining mechanism A02 is linked to rotate forward and to be unlocked, so that a leading bag of the roll of bags can be pulled outwardly. When the motor 30 is not actuated, the bag retaining mechanism A02 will be locked. The roll core retaining shaft is connected with a gear 31. The output end of the motor 30 is connected with a worm 32. The worm 32 links the gear 31 to rotate. A push-button switch 34 is provided outside the motor housing 33. The operation of the motor is controlled by pressing the push-button switch 34. For example, the motor can be started and stopped by the odd and even operation control. Multiple push-button switches may be provided to control the operation of the motor, respectively.

Figure 17:
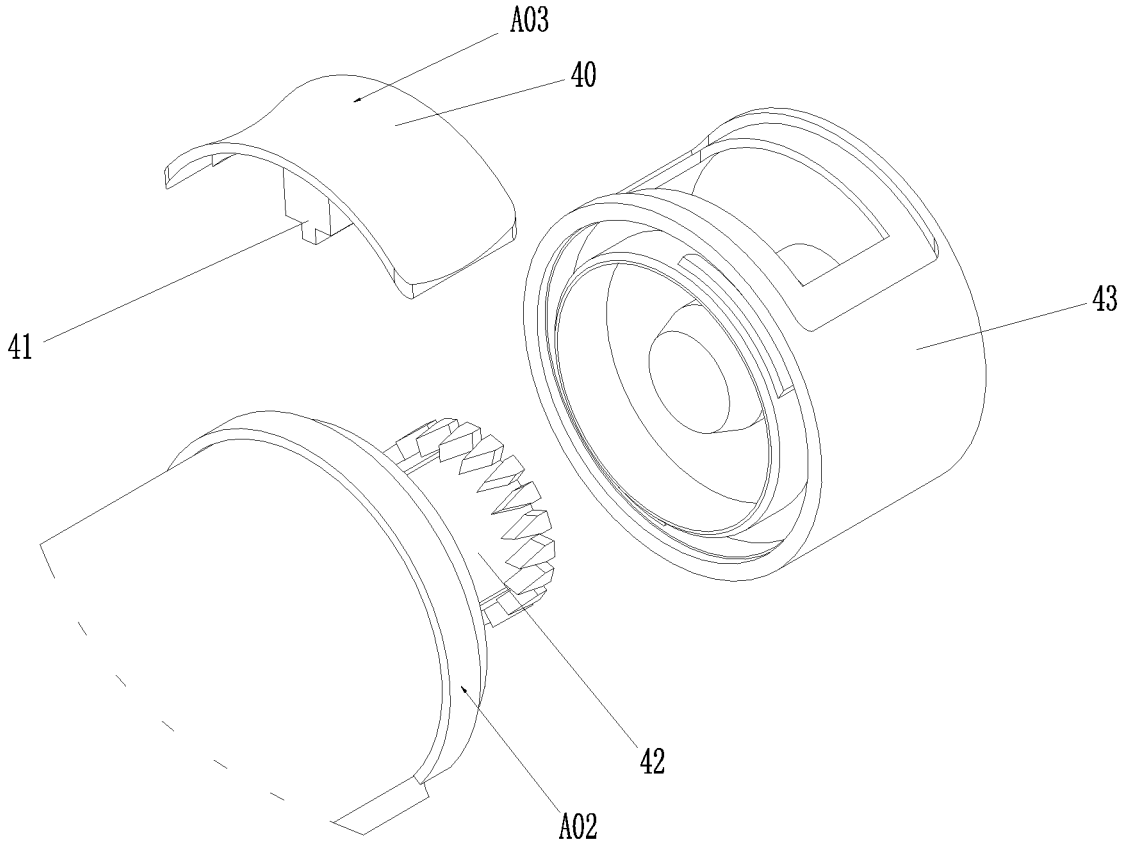
FIG. 17 is a partial exploded view according to a seventh embodiment of the present invention (a slide block non-retraction design)

FIG. 17 shows the specific structure of a seventh embodiment, which is a slide block design. The main difference between the seventh embodiment and the first embodiment is the bag locking mechanism A03.

The bag locking mechanism A03 includes a slide block 40. The slide block 40 is pushed to link the bag locking mechanism A03 for locking or unlocking the bag retaining mechanism A02. The slide block 40 has a second rotation limiting portion 41. When the slide block 40 is pushed forward, the second rotation limiting portion 41 will form a stop on a rotation circumference of the bag retaining mechanism A02. When the slide block 40 is reversely pushed, the second rotation limiting portion 41 will release the stop on the rotation circumference of the bag retaining mechanism A02. Specifically, it refers to the locking and unlocking relationship between the second rotation limiting portion 41 and the roll core retaining shaft 42. The slide block 40 moves left and right along the cap 43. The cap 43 has a notch for receiving the second rotation limiting portion 41. A number of raised teeth arranged at intervals are provided on the outer circumference of the roll core retaining shaft 42. A groove is defined between every adjacent two of the teeth for the second rotation limiting portion 41 to be inserted and locked.

Figure 18:
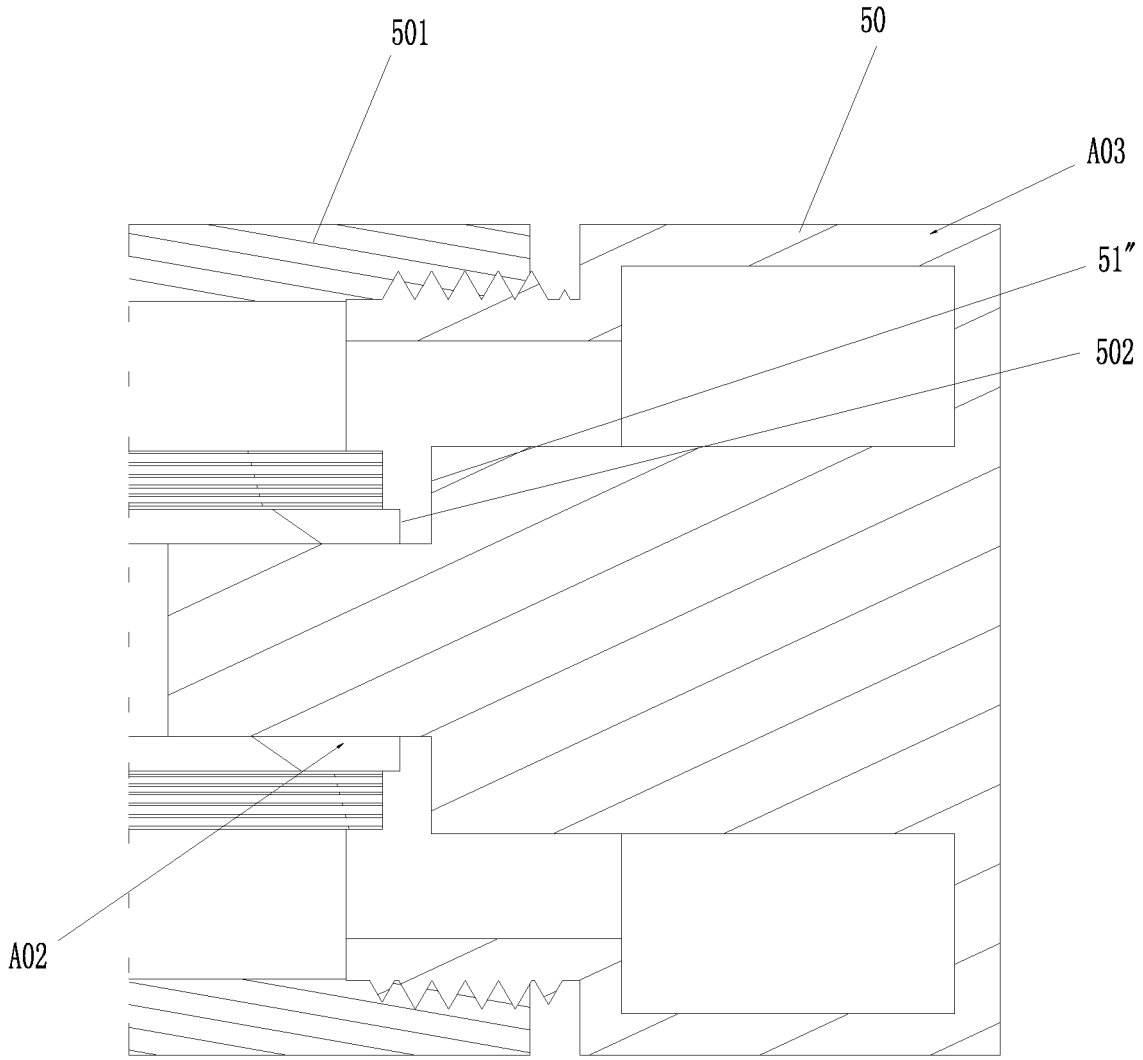
FIG. 18 is a partial exploded view according to an eighth embodiment of the present invention (a simple rotary knob design)

FIG. 18 shows the specific structure of an eighth embodiment, which is a rotary knob design. The main difference between the eighth embodiment and the first embodiment is the bag locking mechanism A03.

The bag locking mechanism A03 includes a rotary knob 50. The rotary knob 50 is rotated to link the bag locking mechanism A03 for locking or unlocking the bag retaining mechanism A02.

The rotary knob 50 is threadedly connected to the housing 501. The rotary knob 50 has a third rotation limiting portion 51". When the rotary knob 50 is rotated forward, the third rotation limiting portion 51" is moved toward the bag retaining mechanism A02 until it is in tight contact with the end surface 502 of the bag retaining mechanism A02, and the bag retaining mechanism A02 cannot rotate. When the rotary knob 50 is rotated reversely, the third rotation limiting portion 51" is moved away from the bag retaining mechanism A02 and keeps a distance from the end surface of the bag retaining mechanism A02.

Figure 19:
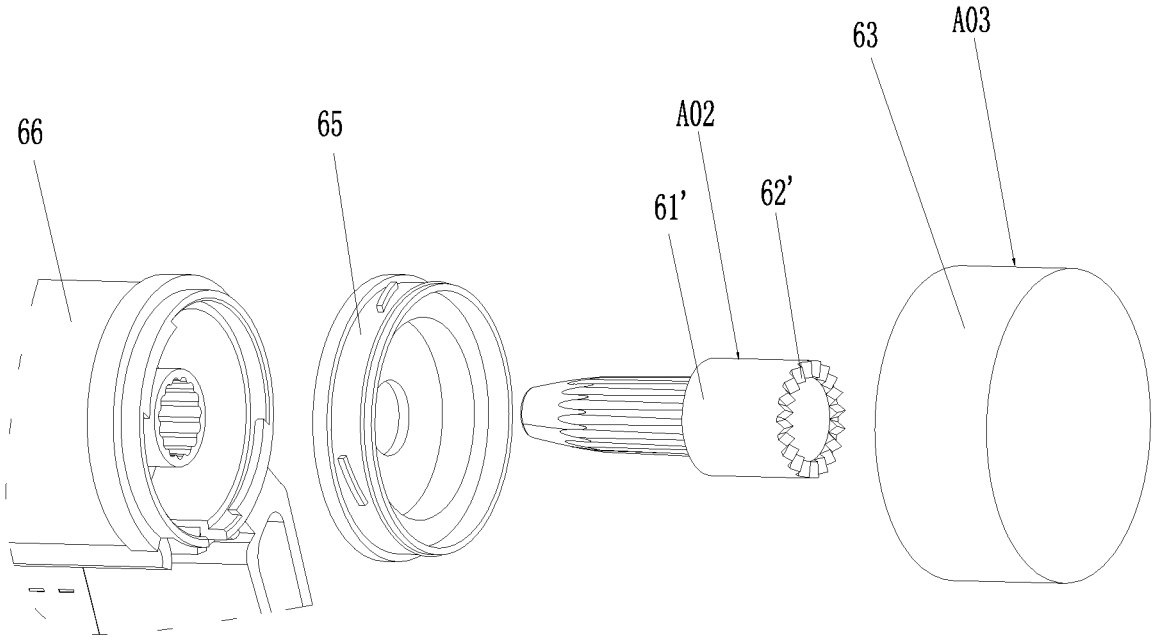
FIG. 19 is a partial exploded view according to a ninth embodiment of the present invention (a rotary knob design)
Figure 20:
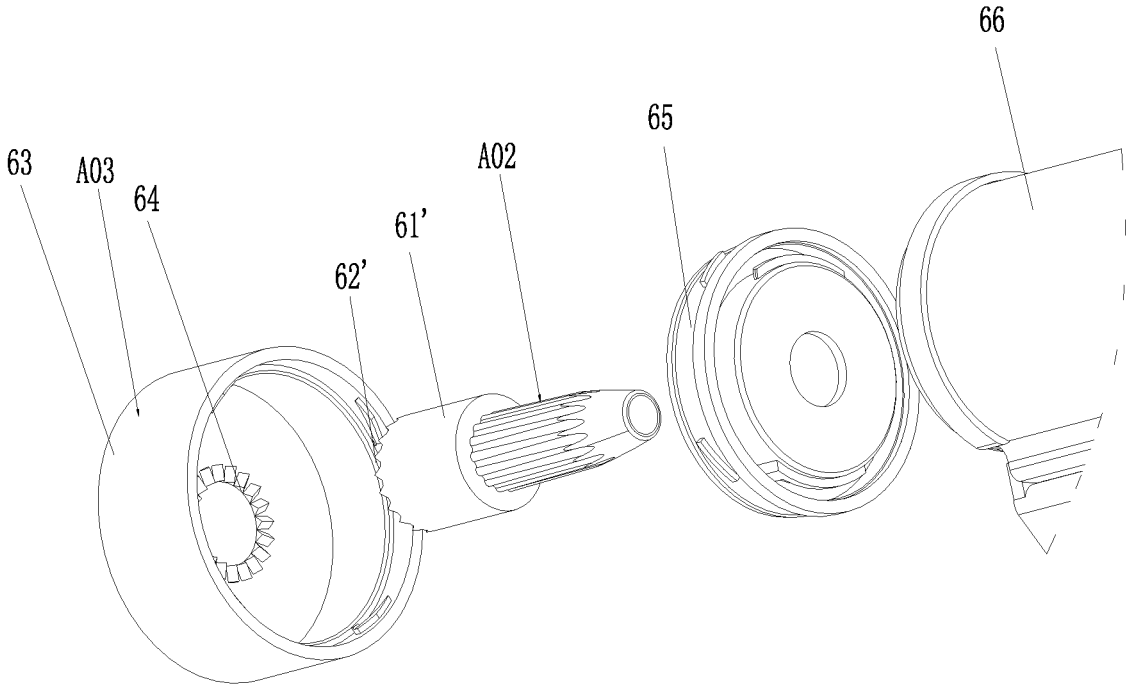
FIG. 20 is another partial exploded view according to the ninth embodiment of the present invention (a rotary knob design)

FIG. 19 and FIG. 20 show the specific structure of a ninth embodiment, which is a relatively complicated rotary knob design. The main difference between the ninth embodiment and the eighth embodiment is described below. The end face of a roll core retaining shaft 61' is formed with a plurality of tooth grooves 62'. The inner end face of the rotary knob 63, facing the tooth grooves 62', is provided with a plurality of raised teeth 64. When the rotary knob 63 is rotated forward, the raised teeth 64 are moved toward the tooth grooves 62' until they are engaged in the tooth grooves 62', and the roll core retaining shaft 61' cannot rotate. When the rotary knob 63 is rotated reversely, the raised teeth 64 are moved to disengage from the tooth grooves 62'. An internal thread is provided on the inner side of the rotary knob 63, and an external thread is provided on the outer periphery of the housing. Alternatively, a fixing connector 65 is provided with an external thread, and the fixing connector 65 is mounted to the housing 66 for mating the rotary knob 63.

FIGS. 21 to 24 show the specific structures of a tenth embodiment to a twelfth embodiment, which is a relatively simple rotary knob design. The main difference between the tenth embodiment and the first embodiment is described below. The bag locking mechanism A03 includes a resistance mechanism. When there is no external force applied to the resistance mechanism, the roll of bags cannot be rotated relative to the housing due to resistance. When an external force is exerted to pull the roll of bags to act on the resistance mechanism to offset its resistance, so as to rotate and unlock the bag retaining mechanism A02. The resistance mechanism is a damping oil, meshing friction surface or magnetic resistance.

Figure 21:
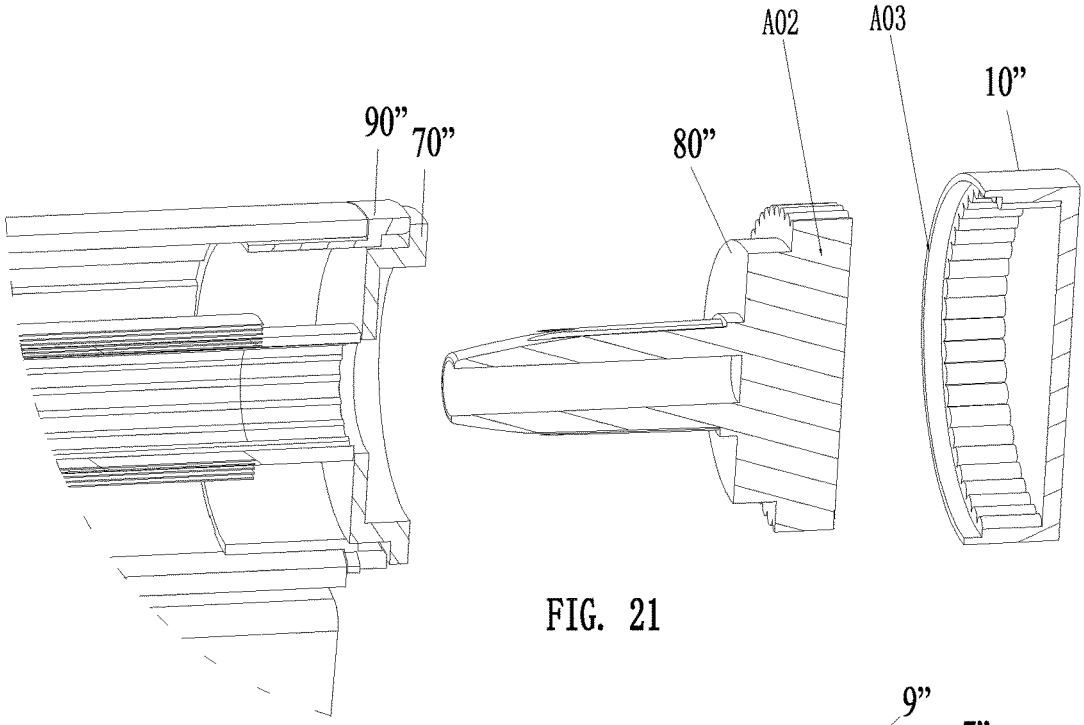
FIG. 21 is a partial exploded view according to a tenth embodiment of the present invention (a meshing friction surface design)

FIG. 21 shows a meshing resistance mechanism, having a cap 10", a connection fixing member 90" and an inner cover 70". The outer circumferential side of the roll core retaining shaft 80" and the inner circumferential side of the cap 10" are formed with toothed friction surfaces. Enough external force is required to pull the roll of bags to offset the meshing resistance, so that the leading bag can be pulled outwardly.

Figure 22:
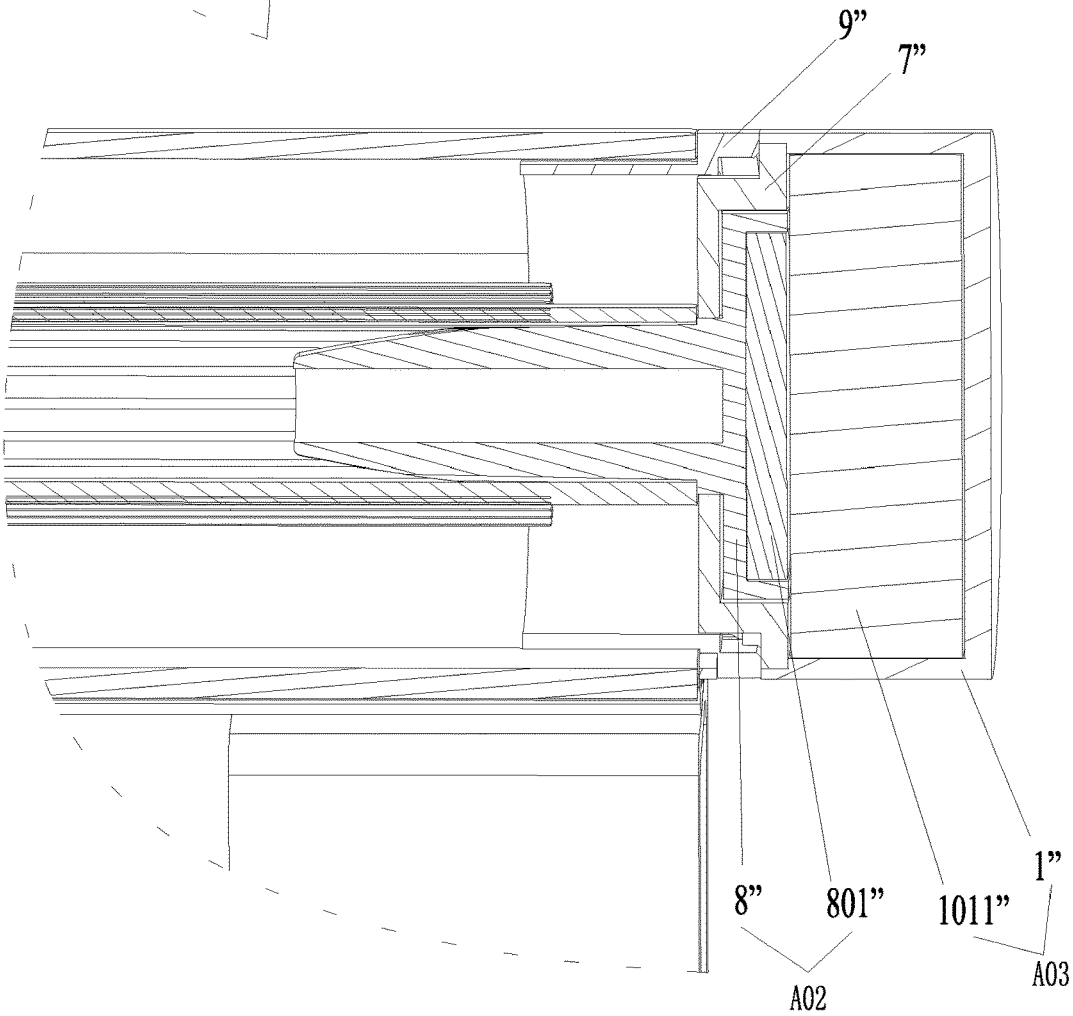
FIG. 22 is a partial cross-sectional according to an eleventh embodiment of the present invention (a magnetic design)

FIG. 22 shows a magnetic resistance mechanism, having a cap 1", a connection fixing member 9" and an inner cover 7". A magnet 801" and a magnet 1011" are respectively arranged on the opposite sides of the roll core retaining shaft 8" and the cap 1" to form a magnetic attraction. Enough external force is required to pull the roll of bags to offset the magnetic resistance, so that the leading bag can be pulled outwardly.

Figure 23:
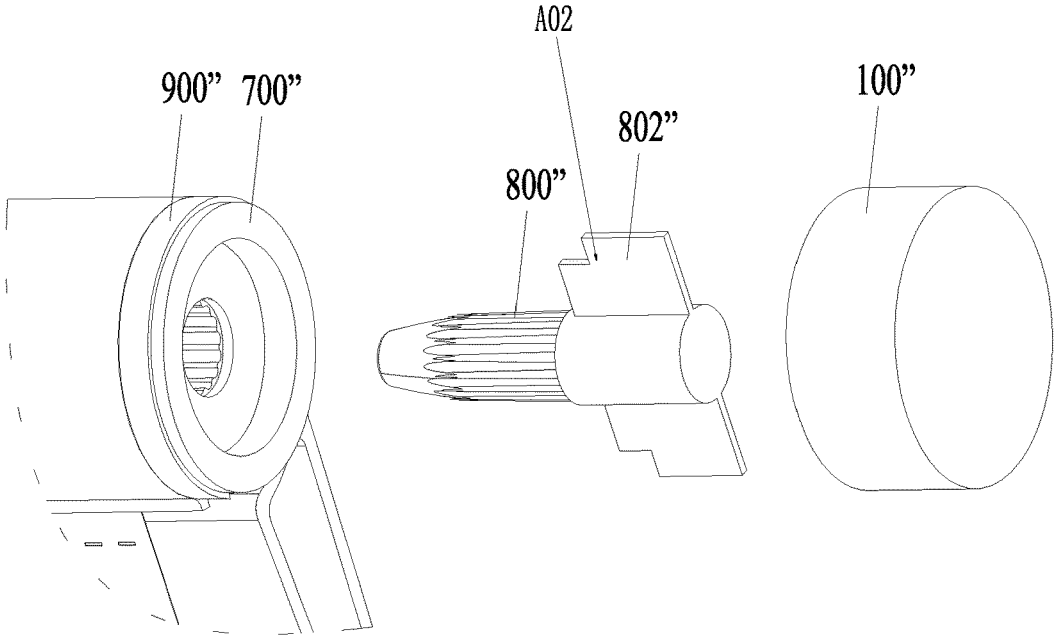
FIG. 23 is a partial exploded view according to a twelfth embodiment of the present invention (a damping oil design)
Figure 24:
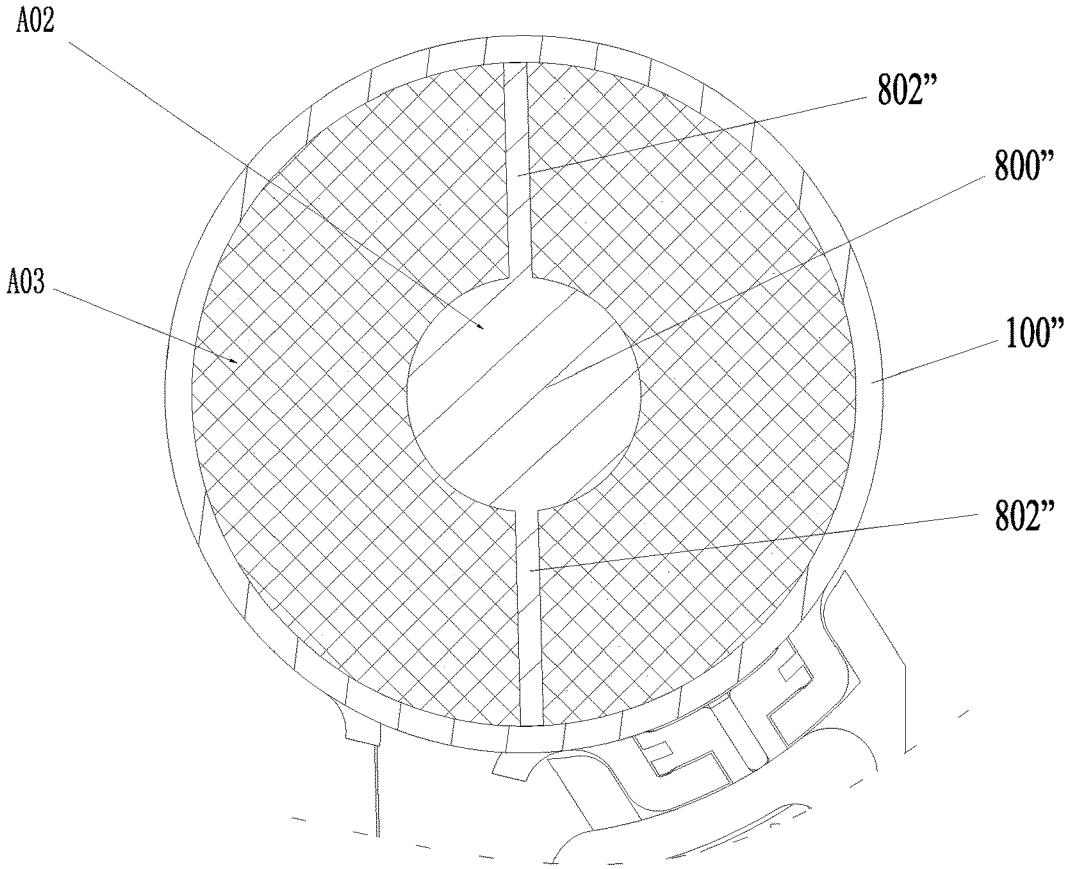
FIG. 24 is a partial cross-sectional view according to the twelfth embodiment of the present invention (a damping oil design).

FIG. 23 and FIG. 24 show a damping oil resistance mechanism, having a cap 100", a connection fixing member 900" and an inner cover 700". The inner cover 700" is installed on the connection fixing member 900". A damping oil chamber is surrounded by the cap 100" and the inner cover 700" and filled with damping oil. The roll core retaining shaft 800" extends into the damping oil chamber. The damping oil is configured to form a resistance to the retaining piece 802" of the roll core retaining shaft 800". Enough external force is required to pull the roll of bags to offset the resistance of the damping oil to the retaining piece 802", so that the leading bag can be pulled outwardly.

The present invention also disclosures a bag dispensing system, comprising the above-mentioned bag dispensing apparatus A01 and a roll of bags disposed in the housing of the bag dispensing apparatus A01. The roll of bags is positioned on the bag retaining mechanism A02 and rotated synchronously with the bag retaining mechanism A02. The roll of bags has a plurality of continuously connected bags 101. A perforated tear line 201 is arranged between every adjacent two of the bags 101. At least one side of each bag 101 has an exposed mouth or a tearable mouth 111. The mouth 111 is located between the tear lines 201 at the upper and lower ends of the bags 101. A leading bag of the bags 101 can selectively extend out from the bag outlet 103 to expose the mouth 111. The leading bag is directly hung on the bag dispensing apparatus A01 for storage use.

The present further discloses a method for storing and using a roll of bags, based on the bag dispensing system comprising the bag dispensing apparatus A01 and the roll of bags.

The bag locking mechanism A03 unlocks the bag retaining mechanism A02. A leading bag of the roll of bags is pulled outwardly from the bag outlet 103. The bag locking mechanism A03 locks the bag retaining mechanism A02 again after the leading bag extends outwardly, so that the bag retaining mechanism A02 and the roll of bags cannot be rotated. The leading bag is hung on the bag dispensing apparatus A01 for use. After the leading bag is filled with some articles, the leading bag 101 with the articles is torn off along the tear line 201 at the upper end of the leading bag 101. The bag dispensing apparatus A01 is preferably placed in a vehicle. When it is necessary to mount a new roll of bags, either end of the housing 11 is opened to take out the roll core 10, and the new roll of bags is sleeved on the roll core 10, and then the end of the housing is closed.

What is claimed is:

1. A bag dispensing apparatus, comprising:

a housing, having a bag outlet;

a bag retaining mechanism, configured to retain a roll of bags; the bag retaining mechanism being rotatably mounted to the housing;

a bag locking mechanism, mounted to the housing for selectively locking or unlocking the bag retaining mechanism; wherein when the bag locking mechanism locks the bag retaining mechanism, the roll of bags cannot rotate along with the bag retaining mechanism; when the bag locking mechanism unlocks the bag retaining mechanism, the roll of bags can rotate along with the bag retaining mechanism;

wherein when a leading bag of the roll of bags is pulled outwardly from the bag outlet, the bag retaining mechanism rotates forward; the bag dispensing apparatus further comprises a retraction mechanism, the retraction mechanism includes a retraction rotating portion configured to control the bag retaining mechanism to rotate reversely;

the retraction mechanism and the bag locking mechanism are arranged on a same side of the housing, the retraction rotating portion links the bag locking mechanism and the bag retaining mechanism to rotate reversely so that the leading bag can be retracted inwardly from the bag outlet;

or, the retraction mechanism and the bag locking mechanism are arranged on opposite sides of the housing, when the bag locking mechanism unlocks the bag retaining mechanism, the retraction rotating portion links the bag retaining mechanism to rotate reversely wherein the leading bag can be retracted inwardly from the bag outlet.

2. The bag dispensing apparatus as claimed in claim 1, wherein the housing has a cylindrical shape, one end of the housing has a roll core positioning end, and another end of the housing is provided with the bag retaining mechanism and the bag locking mechanism.

3. A bag dispensing system, comprising the bag dispensing apparatus as claimed in claim 1 and a roll of bags disposed in the housing of the bag dispensing apparatus; the roll of bags being positioned on the bag retaining mechanism and rotated synchronously with the bag retaining mechanism; the roll of bags having a plurality of continuously connected bags; a perforated tear line being arranged between every adjacent two of the bags, at least one side of each bag having an exposed mouth or a tearable mouth, the mouth being located between the tear lines at upper and lower ends of the bags, a leading bag of the bags selectively extending out from the bag outlet to expose the mouth, the leading bag being directly hung on the bag dispensing apparatus for storage use.

4. The bag dispensing apparatus as claimed in claim 1, wherein the bag locking mechanism includes a button, the button has a first rotation limiting portion; when the button is pressed, the first rotation limiting portion forms a stop on a rotation circumference of the bag retaining mechanism; when the button is pressed again, the first rotation limiting portion releases the stop on the rotation circumference of the bag retaining mechanism.

5. The bag dispensing apparatus as claimed in claim 1, wherein the bag locking mechanism includes a slide block, the slide block has a second rotation limiting portion; when the slide block is pushed forward, the second rotation limiting portion forms a stop on a rotation circumference of the bag retaining mechanism; when the slide block is pushed reversely, the second rotation limiting portion releases the stop on the rotation circumference of the bag retaining mechanism.

6. The bag dispensing apparatus as claimed in claim 1, wherein the bag locking mechanism includes a rotary knob, the rotary knob has a third rotation limiting portion; when the rotary knob is rotated forward, the third rotation limiting portion is moved toward the bag retaining mechanism until it is in tight contact with an end surface of the bag retaining mechanism, and the bag retaining mechanism cannot rotate; when the rotary knob is rotated reversely, the third rotation limiting portion is moved away from the bag retaining mechanism and keeps a distance from the end surface of the bag retaining mechanism.

7. The bag dispensing apparatus as claimed in claim 1, wherein the bag locking mechanism includes a motor, when the motor is actuated, the bag retaining mechanism is linked to rotate forward to be unlocked so that a leading bag of the roll of bags can be pulled outwardly; when the motor is not actuated, the bag retaining mechanism is locked.

8. The bag dispensing apparatus as claimed in claim 1, wherein the bag locking mechanism includes a resistance mechanism, and the resistance mechanism is a damping oil, meshing friction surface or magnetic resistance.

9. The bag dispensing apparatus as claimed in claim 1, wherein the bag retaining mechanism includes a roll core retaining shaft, the roll core retaining shaft is configured to retain the roll of bags; the roll core retaining shaft is rotatably disposed relative to the housing; the bag locking mechanism is configured to lock or unlock the roll core retaining shaft.

* * * * *